US007096795B2

(12) United States Patent
Wike

(10) Patent No.: US 7,096,795 B2
(45) Date of Patent: Aug. 29, 2006

(54) LINEAR STEERING TRUCK

(75) Inventor: Paul S. Wike, St. Joseph, MI (US)

(73) Assignee: Active Steering, LLC, Chicago, IL (US)

( * ) Notice: Subject to any disclaimer, the term of this patent is extended or adjusted under 35 U.S.C. 154(b) by 0 days.

(21) Appl. No.: 10/714,704

(22) Filed: Nov. 17, 2003

(65) Prior Publication Data

US 2004/0221763 A1 Nov. 11, 2004

Related U.S. Application Data

(60) Provisional application No. 60/468,281, filed on May 6, 2003.

(51) Int. Cl.
*B61F 5/38* (2006.01)

(52) U.S. Cl. ..... 105/168; 105/218.2

(58) Field of Classification Search ..... 105/165, 105/167, 168, 171, 199.1, 199.3, 200, 201, 105/182.1, 185, 218.2, 218.1, 219; 384/423; 188/52, 53, 54

See application file for complete search history.

(56) References Cited

U.S. PATENT DOCUMENTS

| | | | | |
|---|---|---|---|---|
| 1,931 | A | 1/1841 | Whitford | |
| 75,705 | A | 3/1868 | McCammon | |
| 299,735 | A | 6/1884 | Candee | |
| 503,831 | A | 8/1893 | Cooper | |
| 642,820 | A | 2/1900 | Harrison | |
| 767,182 | A | 8/1904 | Stephenson | |
| 767,360 | A | 8/1904 | Stephenson | |
| 774,132 | A | 11/1904 | Best | |
| 817,406 | A * | 4/1906 | Stucki | 105/197.05 |
| 875,565 | A * | 12/1907 | Barber | 105/186 |
| 917,522 | A | 4/1909 | Baker et al. | |
| 942,702 | A * | 12/1909 | Barber | 105/200 |
| 992,481 | A | 5/1911 | Clark | |
| 1,228,131 | A | 5/1917 | Pynn | |
| 1,770,174 | A | 7/1930 | Lichtenbert et al. | |
| 1,772,928 | A | 8/1930 | Kijlstra | |
| 1,828,314 | A | 10/1931 | Buckius | |
| 1,877,638 | A | 9/1932 | Baldwin | |

(Continued)

FOREIGN PATENT DOCUMENTS

| | | | |
|---|---|---|---|
| GB | 2 091 660 | * | 8/1982 |

*Primary Examiner*—Mark T. Le
(74) *Attorney, Agent, or Firm*—Mark E. Wiemelt

(57) ABSTRACT

The present invention relates generally to a linear steering truck apparatus comprising a bolster member having two ends, the bolster being located along the transverse axis extending generally perpendicular to the longitudinal axis, generally located between and parallel to the transversely extending axles, a linear steering truck attachable to the car body, a plurality of pedestals, a pedestal engaged to an axle bearing, the axle bearing being rotationally engaged to one end of a transversely extending axle, and at least one pedestal being movably attached to at least one other pedestal situated in the same plane along the longitudinal axis, and rack and pinion steering components, where the geometry of pivot points from one axle to the bolster form a trapezoid and the geometry of pivot points from another axle to the bolster form a parallelogram, the pedestals being pivotably connected so that a lateral force at one axle is reacted by the other axle, wherein the car body mass acts as a pendulum mass restoring force, and the apparatus being steered to the center of the track with either end of the truck leading after the trapezoid side yaws.

27 Claims, 16 Drawing Sheets

U.S. PATENT DOCUMENTS 1,946,409 A 2/1934 McLintock
2,545,956 A 5/1951 Julien
2,756,690 A 7/1956 Miller et al.
2,936,720 A 5/1960 Van Alstine
3,011,458 A 12/1961 Wirth et al.
3,190,237 A 6/1965 Hurtner
4,151,801 A 5/1979 Scheffel et al.
4,294,175 A 10/1981 Harsy
4,413,569 A * 11/1983 Mulcahy ..... 105/168
4,519,329 A 5/1985 Vacher
4,628,824 A 12/1986 Goding et al.
5,024,165 A 6/1991 Panagin
5,123,358 A 6/1992 Kemppanien et al.
5,211,116 A 5/1993 Schneider
5,249,530 A 10/1993 Wike
5,666,885 A 9/1997 Wike
5,918,546 A * 7/1999 Wike ..... 105/168

* cited by examiner 156
78
172
60a
64
62
77
75
76
152
162
70
155
78
150
166
66
146
154
82
81

72
160
164
79
153
68
154
147
74
170
83
174
26

LINEAR STEERING TRUCK

PRIORITY

This is a non-provisional application of provisional patent application Ser. No. 60/468,281 filed May 6, 2003.

BACKGROUND OF THE INVENTION

1. Field of the Invention

The present invention relates to the field of trucks for railroad cars, and in particular, to steerable trucks for railroad cars.

2. The Prior Art

The wheels which are used on railroad trucks are, almost universally, formed with conical tapered profiles. That is, the diameters of the wheels decrease, with the portions having the smallest diameter facing outwardly, relative to the railroad car. In addition, rims, having overall diameters substantially greater than the largest diameter portion of the tapered wheel surface, are located at the innermost portions of the wheels, and placed on the truck axles and axle bearings, such that the distance between the rims of the wheels on an axle (collectively, "wheel set") is slightly less than the distance between the inside edges of the rails.

In prior art conventional railroad trucks, the axles would be fixed relative to the truck. Typically, there would be provided two trucks situated adjacent the ends of a railroad car. Each truck is typically connected to the railroad car by a short, 14 or 16 inch diameter, cylindrical post extending downwardly from the carbody, which is received by a plate mounted generally centrally relative to the truck. The center post in such a typical prior art configuration would typically have been configured to permit a certain amount of pivoting of the truck, relative to the railroad car body. As a practical matter, the frictional forces generated by the surface contact area between the post and the plate, and the tremendous weight of the carbody, means that the amount of resistance to pivoting will be great. Thus, the friction between the truck bolster center plate and car body center bowl cause the truck to stick at any given position during travel.

However, steering forces between the wheels and rail are great enough to overcome this friction force. The steering forces cause the truck to yaw toward a position in the direction of travel. As the truck approaches the direction of travel, the steering forces decrease to a point no longer greater than the friction forces between the truck bolster center plate and car body center bowl. Since the friction forces between the plate and bowl are now greater than the steering forces, the frictions again cause the truck to stick in a position until the steering forces become great. This continuous entice energy process results in the truck never becoming truly aligned to the track. Additionally, this continuous entice energy process creates rolling resistance and wear on straight track as well as in curves.

This oscillation of the truck pivoting about the center post, describes a sinusoidal path along the track. As speed increases this phenomenon is more obvious and at higher speeds this becomes an unacceptable condition. This phenomenon is commonly called "hunting". Hunting starts at low speeds and can lead to unacceptable lateral wheel force, acceleration, and frequency unless constrained. The instability transfers rolling energy into undesirable lateral energy which creates rolling resistance, lading and car damage, and wheel and track wear.

As a railroad car having such prior art trucks would enter a curve, the rails move from under the wheels. The radius of one wheel increases as the radius of the other decreases. The different diameters creates a larger circumference on one wheel and smaller on the other. The difference in circumference causes one wheel to travel further than the other for the same revolution. The difference in travel causes the wheels and axle to turn in the direction of the curve. Ideally, the large circumference matches the length of the outside rail and the small circumference the inside rail.

The natural tendency of a single axle wheel set, in a curve, is to assume a posture is which the axle "points" to the center of curvature of the curve. This movement of a single axle may be referred to as "going radial". In a prior art two wheel set truck with fixed axles, the axles would not be free to assume this described posture independently of one another, and the truck as a whole would be forced to rotate about the center of the truck. This condition creates high forces on the wheel sets and the truck, increases wear on the truck components, and increases rolling friction, resulting in increased fuel consumption as a result of the additional energy which had to be expended to keep the railroad cars moving. Additionally, these high forces also wear the track and the wheels.

A typical prior art truck configuration would comprise two longitudinally extending (i.e., track-wise extending) side frames, with a transversely extending bolster attached to the side frames (the "three-piece truck"). The axles of the wheel sets would be mounted fore and aft of the bolster, with the axle ends being generally fixed relative to the side frames.

Even though nominally rigidly constructed, such a truck configuration would, under sufficient loading (such as during curves), deform. Typically, this deformation would take the form of the side frames, bolster and wheel-sets skewing relative to one another to form a parallelogram, as the forces exerted on the wheels push the axles to seek yawed positions through the curve. Such parallelogramming is believed to be a common cause of railroad car derailment at low speed in curves. In rigid frame trucks this parallelogramming does not occur.

Accordingly, it can be seen that making trucks rigid and mounting them rigidly to car bodies, in an effort to eliminate hunting, and providing truck pivoting and/or flexibility, to permit truck or axle yawing or steering in curves, can and have created a design impasse for the creation of an effective three piece truck. Frame bracing of the three piece trucks helps, but still does not give a satisfactory result on wheel life and track loads.

Numerous attempts have been made to produce trucks which satisfy the requirements for efficient rolling during both straight runs and curves. Such attempts have included the provision of resilient or elastic members in the side frames and/or bolsters, pivot-mounted axles and side frames with damping apparatus like shock absorbers, and various forms of cross-bracing and the like. Such prior art configurations typically have resulted in truck structures which are costly, heavy, and/or overly complex and prone to failure or requiring extensive maintenance and replacement of components.

One such attempt is illustrated in U.S. Pat. No. 5,249,530. The '530 patent discloses a steering apparatus that responds to high speed single rail vertical curve change so accurately that the truck would yaw as if it had detected a lateral curve. The car mass would continue in the original direction of travel creating high lateral force, which would lift the inside wheels from the rail. The alternating and repeated single rail vertical curves is referred to by the Association of American Rail Roads as the twist and roll regime.

To correct the problem an active lateral suspension steering system in combination with steering was conceived in U.S. Pat. No. 5,666,885. In the '885 patent, the lateral suspension movement was intended to retard or add steering in lateral acceleration regimes. The '885 invention has a prompting mechanism to facilitate turning, however the lateral suspension steering of the '885 patent is prone to high friction and not able to demonstrate the effects of steering combined with the lateral suspension.

Another such attempt to satisfy the requirements for efficient rolling during both straight runs and curves is illustrated in U.S. Pat. No. 5,918,546. The '546 invention incorporated a low friction lateral suspension steering that through lateral acceleration retards or adds steering. Although the mechanism provided the concept, it is too complex for practical application.

SUMMARY OF THE INVENTION

The present invention advantageously overcomes the limitations in the conventional art and prior solutions. In view of the foregoing disadvantages inherent in the known types of railroad trucks now present in the prior art, the present invention provides a new steerable railroad truck construction.

The general purpose of the present invention, which will be described subsequently in greater detail, is to provide a new steerable railroad truck which has many of the advantages of the prior art mentioned heretofore and many novel features that result in a new steerable railroad truck which is not anticipated, rendered obvious, suggested, or even implied by any of the prior art railroad truck devices, either alone or in any combination thereof.

To attain this, the present invention generally comprises a truck that can be steered through curved track in an optimum manner and yet remain stable with virtually no hunting or oscillation in straight track sections. The present invention creates stiffness through the steering mechanisms to hold the wheelsets aligned to straight and curved track and eliminates the frictions associated with hunting or oscillation. The present invention accomplishes pure rolling by utilizing low friction side bearings to support the car body, a side frame suspension to support connection of the apparatus to wheelsets, and combined car body steering component. The present invention thus limits friction while adding stiffness to provide steering in unbalanced, balanced and overbalanced lateral curves, single rail vertical curves as well as lateral perturbations, thereby accomplishing pure rolling. In addition, the steering component constantly adjusts the axle angle of attack when track perturbations occur, thereby completely eliminating hunting.

There has thus been outlined, rather broadly, the more important features of the present invention so that the detailed description of the preferred embodiment that follows may be better understood, and so that the present contribution to the art may be better appreciated. There are additional features of the present invention that will be described hereinafter in the detailed description of the preferred embodiment and which will form the subject matter of the claims appended hereto.

In this respect, before explaining at least one embodiment of the present invention in detail, it is to be understood that the present invention is not limited in its application to the details of construction and to the arrangements of the components set forth in the following description or illustrated in the drawings. The present invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the present invention in any way.

These together with other objects of the present invention, along with the various features of novelty which characterize the present invention, are pointed out with particularity in the claims annexed to and forming a part of this disclosure. For a better understanding of the present invention, its operating advantages and the specific objects attained by its uses, reference should be had to the accompanying drawings and descriptive matter in which there is illustrated a preferred embodiment of the present invention.

It is therefore an object of the present invention to provide a truck which is configured to permit and accommodate the axles' natural tendency to go radial, so as to permit more efficient and less damaging rolling action in curves.

It is another object of the present invention to provide a truck which is configured to have a reduced tendency to hunt, during straight run travel, so as to reduce the damage and rolling inefficiencies associated with hunting, and in the process also increase speed capability.

It is a further object of the present invention to provide a truck having the characteristics sought, which has a simplified and efficient configuration.

It is an object of the present invention to achieve increased productivity by applying the concept of pure rolling at the wheel to the rail interface.

It is an object of the present invention to consume energy only in the direction of rolling and not divert or transfer that energy laterally or vertically.

It is an object of the present invention to achieve virtually pure rolling by controlling the angle of attack between the wheel and rail interface.

Thus it is another object of the present invention to control the angle of attack between the wheel and rail interface to achieve virtually pure rolling in unbalanced as well as balanced, overbalanced curves and lateral perturbations.

It is yet another object of the present invention to create stiffness through the steering mechanisms to hold the wheelsets aligned to straight and curved track.

It is still another object of the present invention to eliminate frictions associated with hunting or oscillation.

These and other objects of the present invention will become apparent in view of the present specification, claims and drawings.

BRIEF DESCRIPTION OF THE DRAWINGS

The foregoing and other additional objects of the present invention will be readily appreciated by those skilled in the art upon gaining an understanding of the preferred embodiment as described in the following detailed description and shown in the accompanying drawings in which.

DETAILED DESCRIPTION OF THE PREFERRED EMBODIMENT

Figure 1:
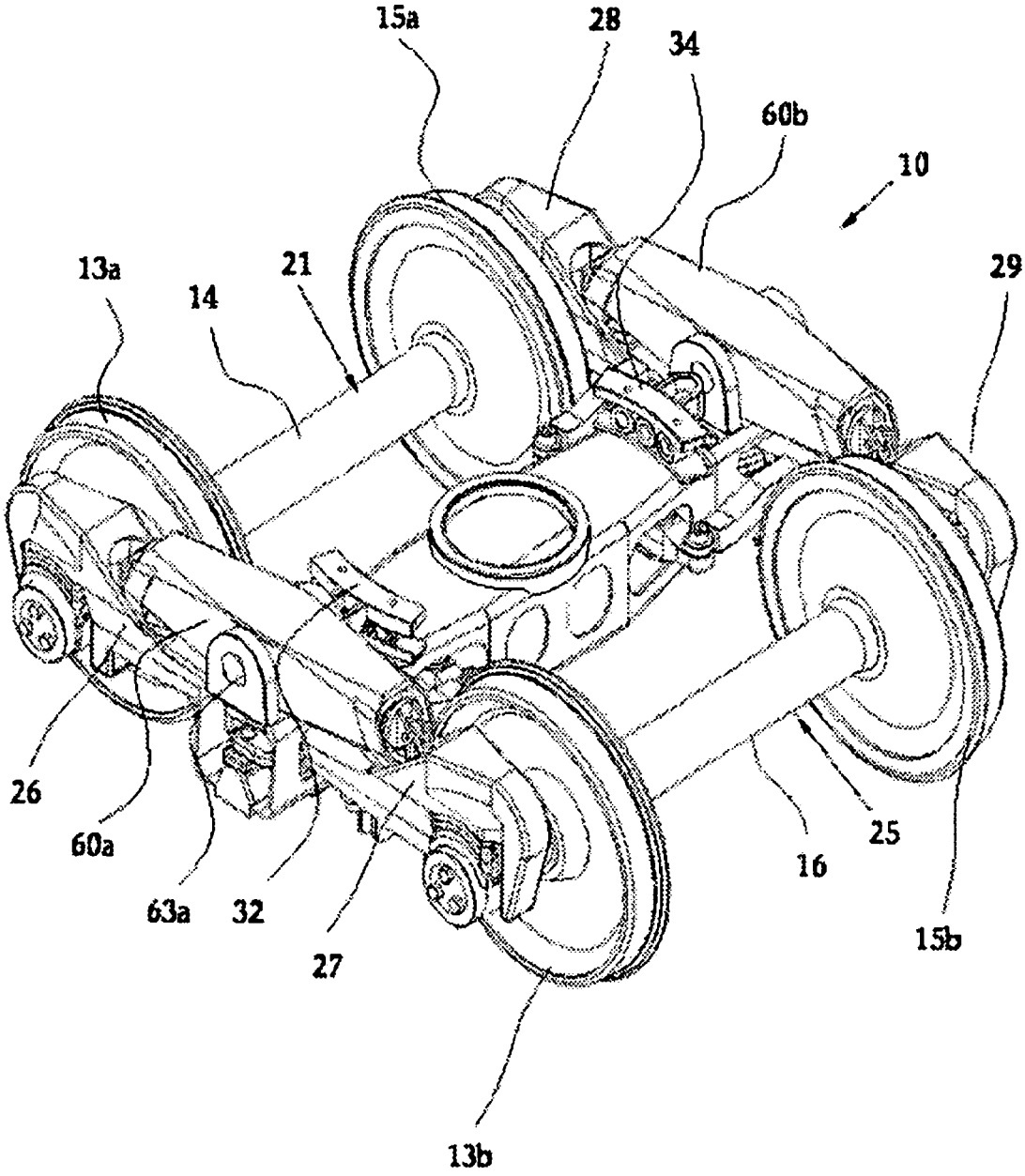
FIG. 1 is an illustration of an elevated side view of the apparatus 10 of the linear steering truck device.

While this present invention is susceptible of embodiments in many different forms, there are shown in the drawings and will be described in detail herein, a preferred embodiment, with like parts designated by like reference numerals and with the understanding that the present disclosure is to be considered as an exemplification of the principles of the present invention, and is not intended to limit the claims to the illustrated preferred embodiment.

Figure 2:
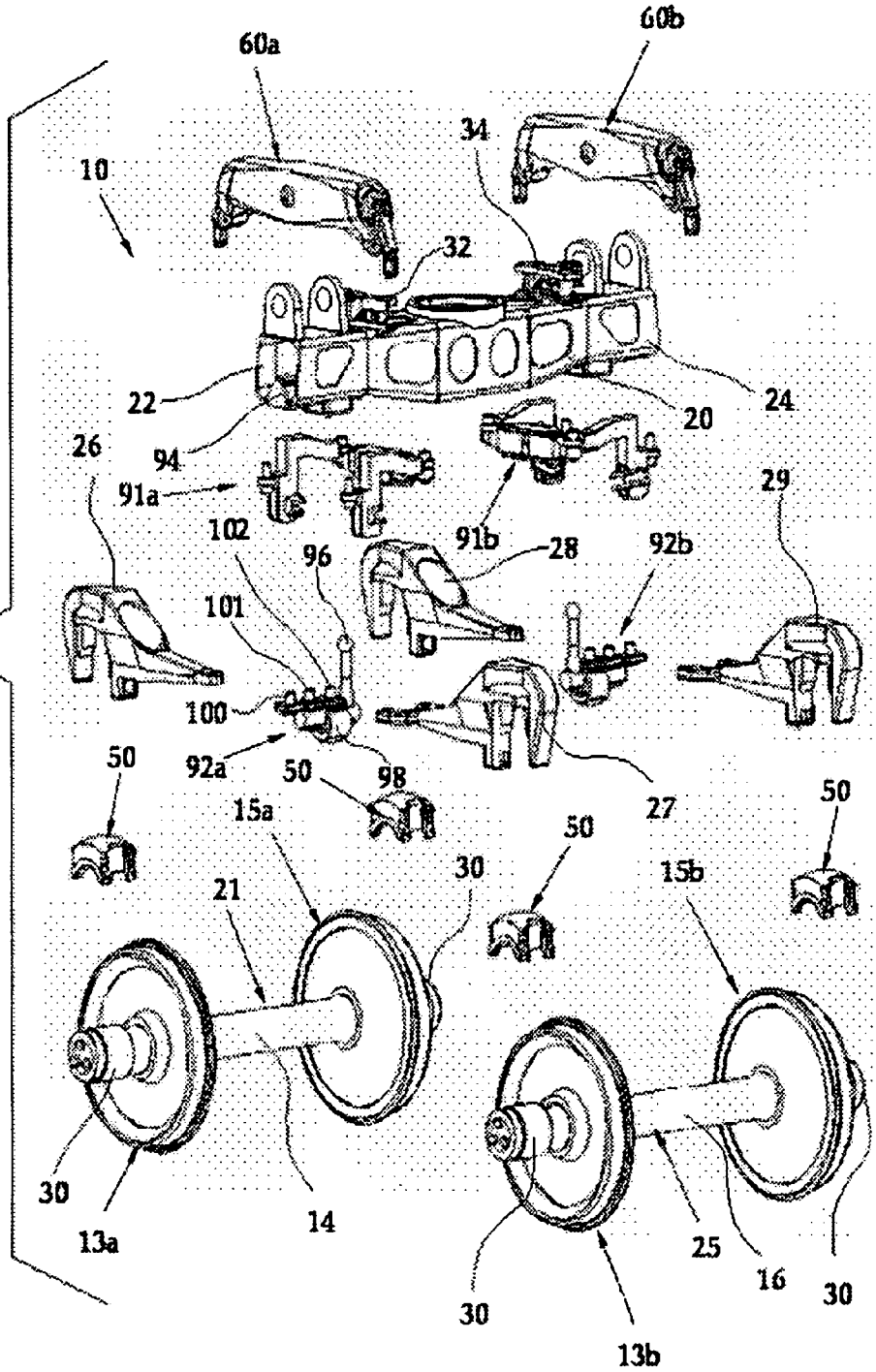
FIG. 2 is an illustration which shows an exploded side elevation view of the preferred embodiment of the apparatus 10 of a linear steering truck device of FIG. 2.
Figure 3:
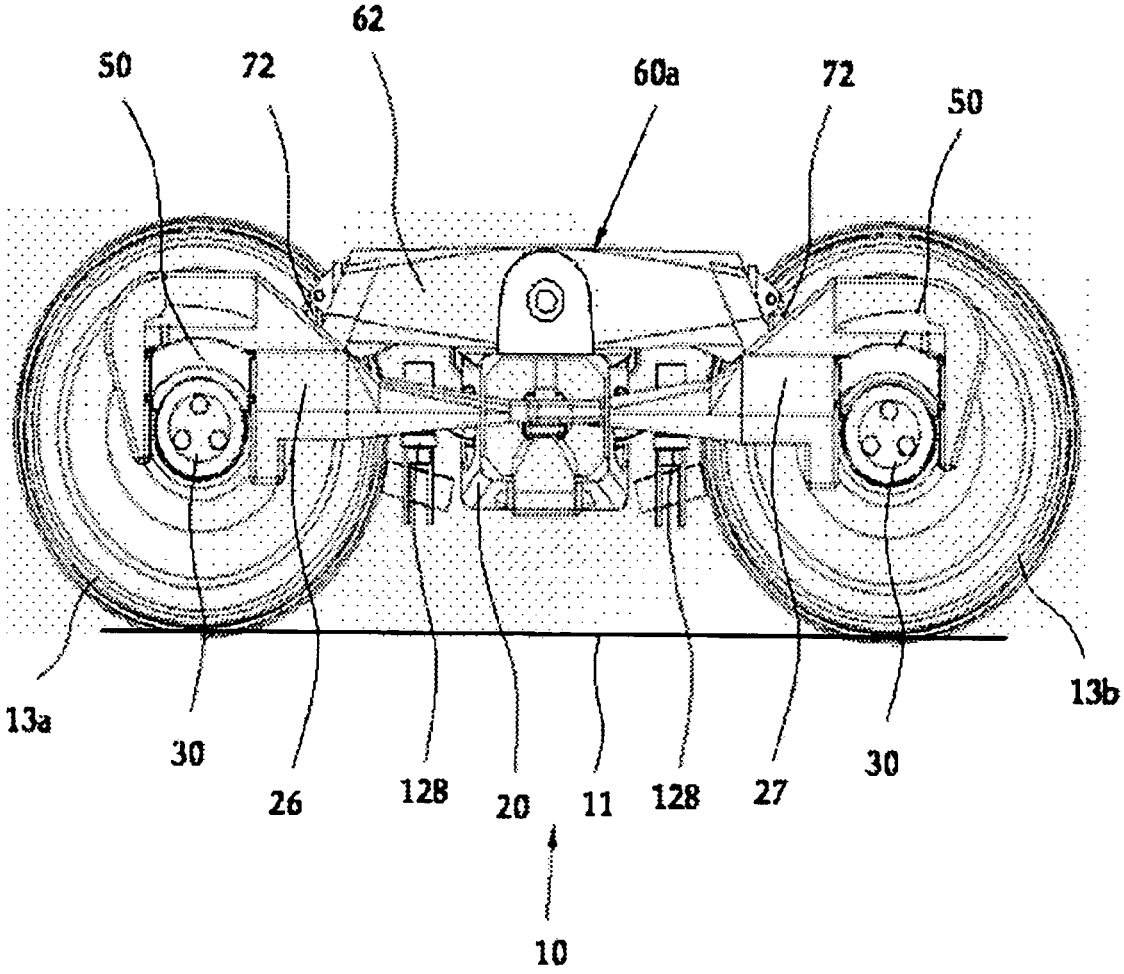
FIG. 3 is an illustration which shows a side view of apparatus 10.

FIG. 1 is an elevated side view of the preferred apparatus 10. FIG. 2 is an exploded perspective view of the linear steering truck apparatus 10 according to a preferred embodiment. FIG. 3 is a side view of apparatus 10 along railroad tracks 11.

Figure 4A:
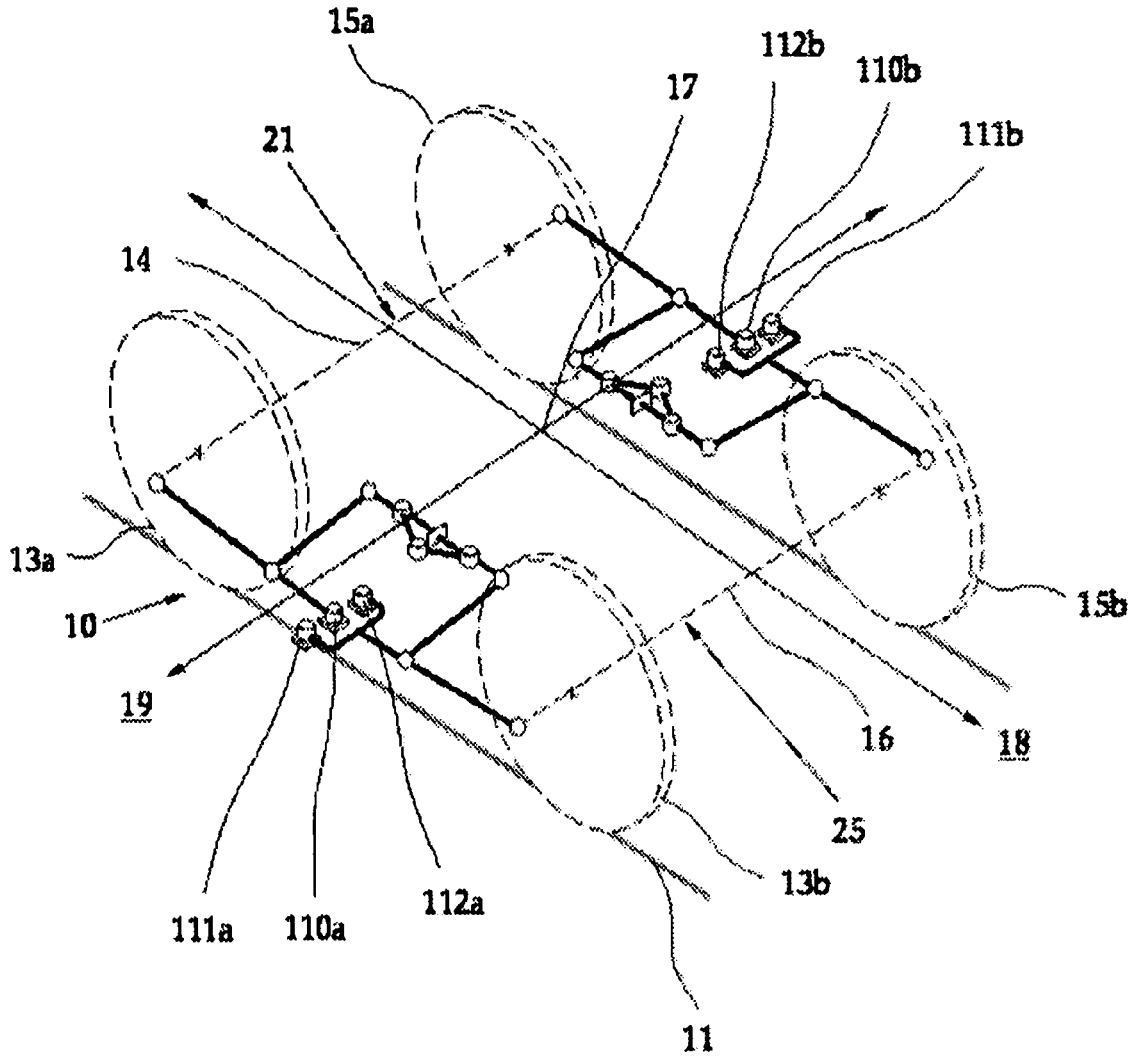
FIG. 4A is an illustration which shows a graphical representation of wheel set orientation and pivot points relative to the track and frame for straight track operation.

As shown for perspective in FIG. 4A, the linear steering truck apparatus 10 has a longitudinally extending axis 18 in the direction of travel of the apparatus 10 when it is traveling in a straight line along tracks 11. Additionally, the linear steering truck apparatus 10 has a transverse axis 19 extending generally perpendicular to the longitudinal axis 18. Positioned parallel to the transverse axis 19 are a first transversely extending axle 14 and a second transversely extending axle 16, as shown in FIG. 4A. Wheels 13*a* and 15*a* are affixed to axle 14 forming a wheel-set 21, as will be shown in FIG. 1. Similarly shown in FIG. 1 is another wheel-set 25 formed by wheels 13*b* and 15*b* being affixed to the axle 16.

As shown in FIG. 4A, positioned generally along the transverse axis 19 at a midpoint 17 along the longitudinal axis 18 between the axles 14 and 16, and generally parallel to axles 14 and 16 is positioned a bolster 20, not shown in FIG. 4A. The bolster 20, as shown in FIG. 2 and wheel-set alignment is a common configuration in railroad truck design. Typically, a bolster 20 is affixed to the wheel-sets and the car body is connected to the bolster by traditional means, including a post and bowl combination, such as are known in the art. However, the preferred embodiment does not utilize any of the traditional combinations. Instead, as shown in FIG. 1 and will be discussed in more detail in FIGS. 5A and 5B, the preferred embodiment has side bearings 32, 34 that provide an interface between the bolster 20 and the railroad car body 12, thereby connecting the apparatus 10 to the car body 12.

Figure 5A:
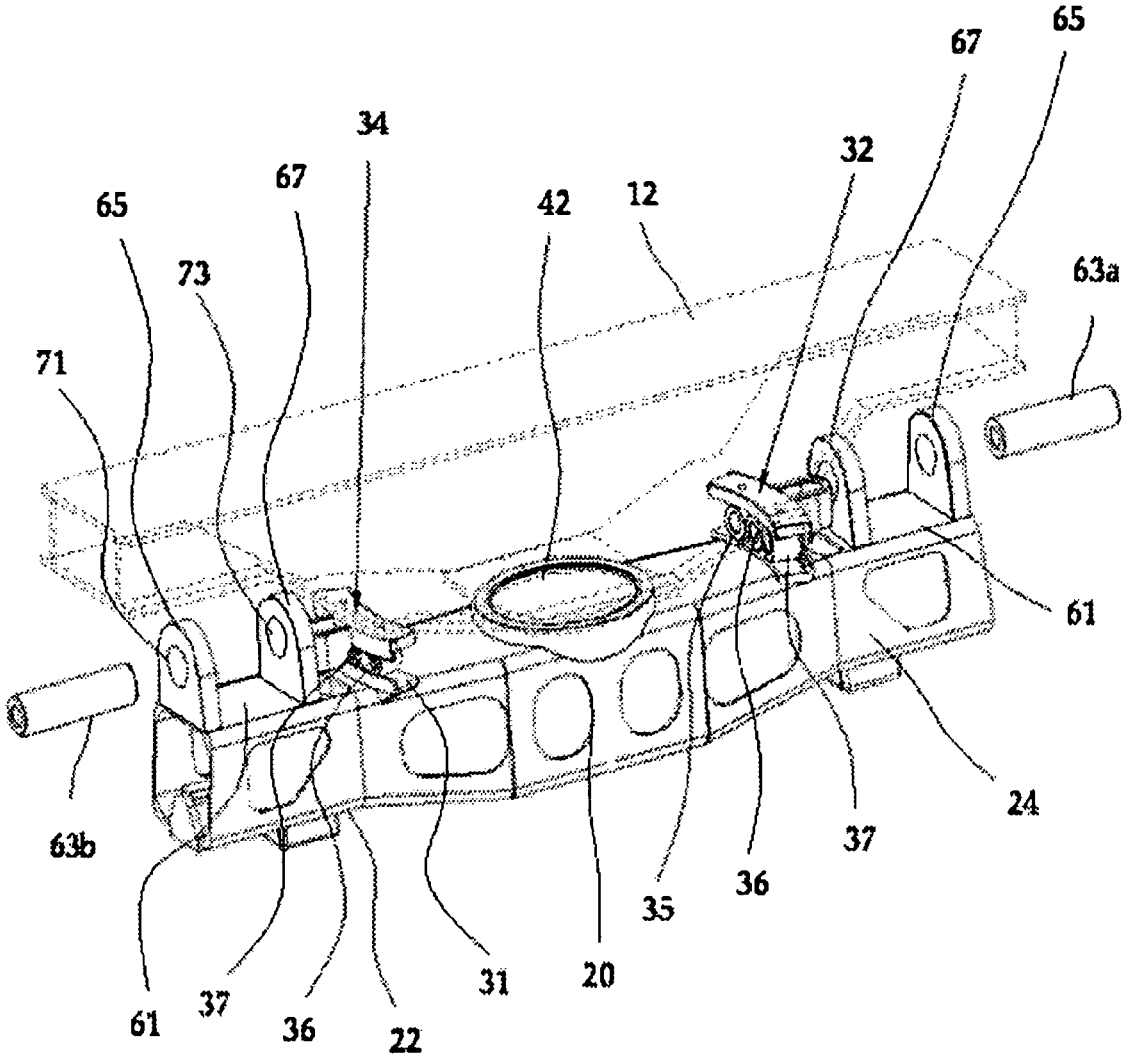
FIG. 5A is an elevated perspective view of bolster 20 and the side bearings 32.

As shown in FIG. 2, the bolster member 20 has two ends, a first bolster end 22 and a second bolster end 24. Each bolster end 22 and 24 connects to a respective equalizing side frame suspension 60*a*, 60*b*. The equalizing side frame suspensions 60*a*, 60*b* are secured to each respective bolster end 22, 24 by a pin joint 63*a*, 63*b*, as shown in FIG. 5A and discussed later in more detail. This connection allows the equalizing side frame suspensions 60*a*, 60*b* to rotate and carry substantially equal loads. As shown in FIG. 2, a first equalizing side frame suspension 60*a* supports a pair of pedestals 26, 27, which are situated in the same plane parallel to the longitudinal axis 18, as shown in FIG. 4A, and a second equalizing side frame suspension 60*b* supports a pair of pedestals 28, 29, which are situated in the same plane parallel to the longitudinal axis 18.

As shown in FIG. 2 and will be discussed in more detail in FIGS. 6A and 6B, each pedestal 26, 27, 28, 29 engages an axle bearing 30 by being formed to rest on a bearing adapter 50, which in turn rests on an axle bearing 30. The axle bearing 30 is formed to fit around one end of an axle 14, 16. This configuration permits the connection of the wheel-sets 21, 25 to apparatus 10 and car body 12, not shown. As shown in FIG. 2 and will be discussed in more detail in FIG. 9, in the preferred embodiment each pedestal 26, 27 and 28, 29 movably attaches to another pedestal 26, 27 and 28, 29 by a steering component 90 and equalizing side frame suspension 60*a* and 60*b*. The steering component 90 also provides the preferred means for performing car body steering.

Figure 5B:
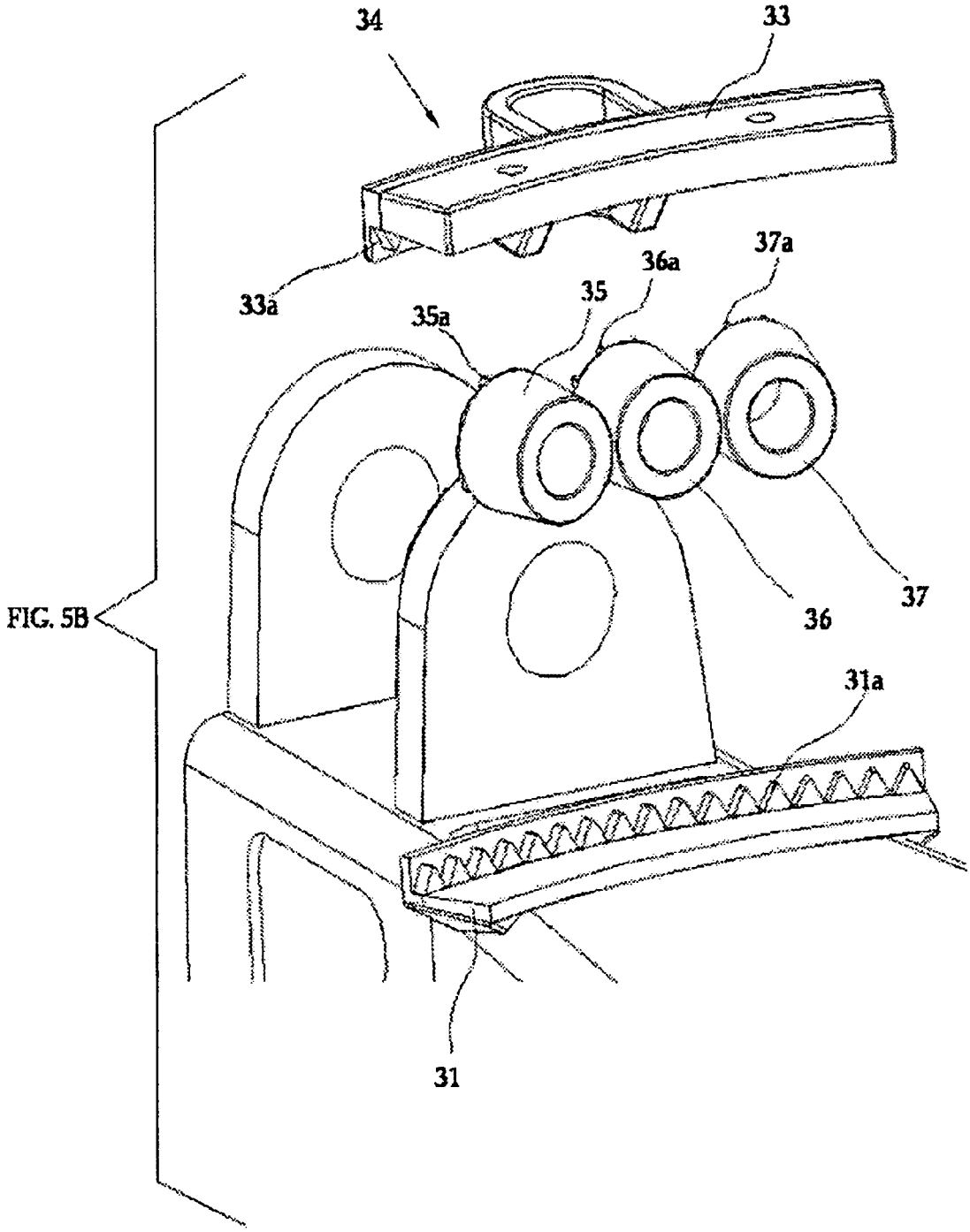
FIG. 5B is an exploded perspective view of side bearing 32.

FIGS. 5A and 5B depict the preferred means for attaching the apparatus 10 to the car body 12. As shown in FIG. 5A, a railroad car body 12, represented as hatched lines, can be mounted to the linear steering truck apparatus 10 by resting a car body bolster of the car body 12 onto a plurality of side bearings 32, 34. As shown in FIG. 5A, a side bearing 32, 34 is placed proximate to each end of the bolster 22, 24. As shown in FIG. 5B, which is an exploded perspective of side bearing 34, the preferred side bearing 34, contains three conical rollers 35, 36, 37 situated between the plates 31 and 33. Plate 31 is preferably formed as part of the bolster 20, as shown in FIG. 5A. Alternatively, the plate 31 can be formed and rested on the bolster 20, or alternatively, the plate 31 can be affixed to the bolster 20 by conventional means, such as a bolted connection. Although use of the side bearing 32, 34 is the preferred embodiment, the steering mechanisms of the apparatus 10 will perform as intended when traditional car body mounting is used.

In the preferred embodiment as shown in FIG. 5A, rollers 35, 36, 37 each have interconnecting teeth 35*a*, 36*a*, and 37*a*, respectively. As shown in FIG. 5A, teeth 35*a*, 36*a*, 37*a* interlock with teeth 31*a* and 33*a*, thereby timing the rollers 35, 36, 37 between plates 31 and 33 and preventing unwanted rubbing and friction. In the alternative, a spacer (not shown) may be employed to prevent contact of the rollers 35, 36, 37 to each other thereby eliminating additional friction points.

When the car body 12 is placed on the side bearings 32, 34, as shown in FIG. 5A, the center plate post (not shown) of the car body 12 is fitted into the through hole 42 in the bolster 20 in order to center the car body 12 onto the linear steering truck apparatus 10. The through hole 42 of the bolster 20 thus takes only longitudinal and lateral loads, while the side bearings 32, 34 support the vertical load of the car body 12. As compared to conventional car body attachment set-ups, as discussed above, the use of side bearings 32, 34 is a light weight design that decreases friction by eliminating turning resistance and wear and by providing a steering connection to the car body 12. Moreover, the preferred construction, where the car body mass is supported by side bearings 32, 34 located at near the edges of the bolster 10, uniquely directs the car body load path equally through the entire bolster 10. In the preferred embodiment, the side bearings 32, 34, bolster 20 and pedestals 26, 27, 28, 29 are made of a high strength ferrous casting, although a high strength material of similar strength may be used. In the preferred embodiment, the conical shape of the rollers provides ideal radial rolling with little or no friction.

As shown in FIG. 2, an axle bearing 30 is fitted around one end of an axle 14, 16 of a wheel-set 21, 25. The axle bearing 30 can be a conventional rail axle bearing structure, such as the cylindrical axle bearing 30 as illustrated. As shown in FIGS. 2, 6A and 6B, the bearing adapter 50 is formed to rest on an axle bearing 30. In turn, each pedestal 26, 27, 28, 29 is formed to rest on a bearing adapter 50, thereby connecting the apparatus 10 to the wheel-sets 21, 25.

Figure 6A:
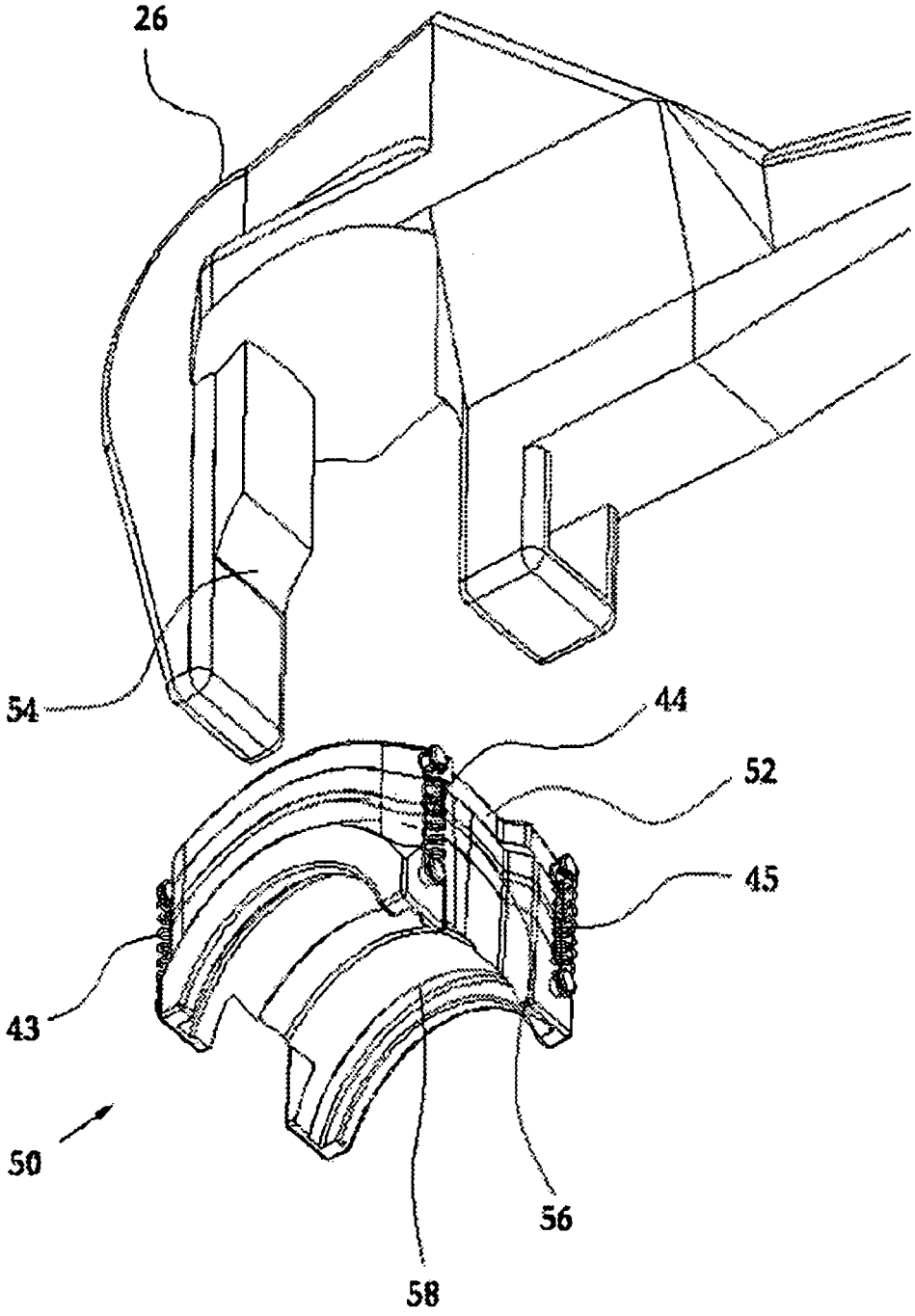
FIG. 6A is an illustration which shows the alignment of a bearing adapter 50 relative to a pedestal 26.
Figure 6B:
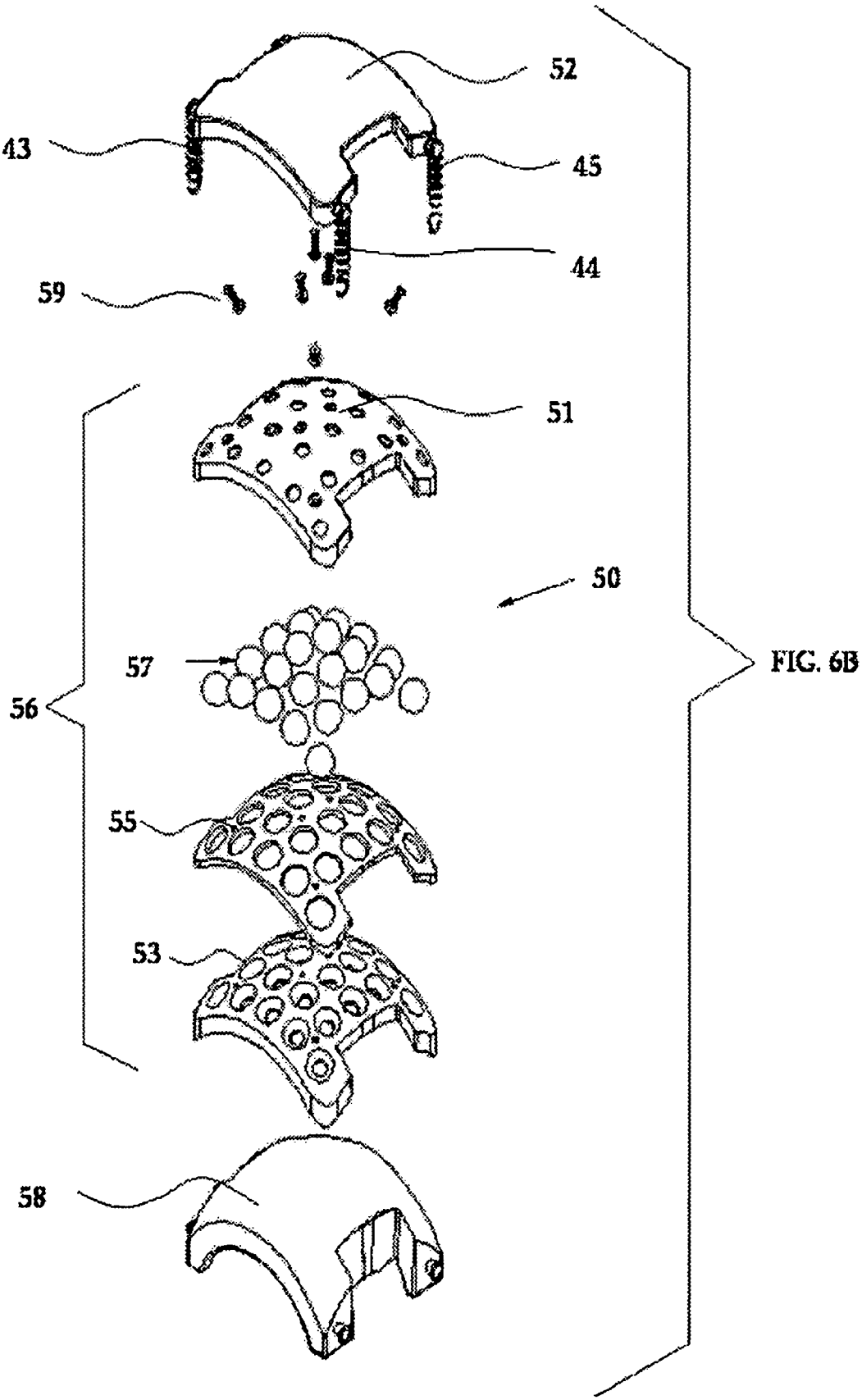
FIG. 6B is an exploded perspective view of the bearing adapter 50.

As shown in FIG. 6A, the bearing adapter 50 is preferably constructed of an outer race 52, assembly springs 43, 44, 45, 47 (not shown in FIG. 5), a ball bearing cage assembly 56, and an inner race 58. The outer race 52 has a spherical interface providing vertical centering alignment of the pedestal 26 about the center of rotation of the axle bearing 30, as shown in FIG. 6A. As shown in FIG. 6A, the pedestal 26 has a pedestal jaw 54, which is preferably a standard jaw interface and which movably attaches the pedestal 26 to bearing adapter 50. Preferably, the bearing adapter 50 is formed to receive the pedestal jaw 54. Preferably, the bearing adapter 50 is formed in a tapered fashion and formed to have a female portion to receive the male pedestal jaw. The connection retains the bearing adapter 50 within the pedestal 26 both longitudinally and laterally. Tapered clearance is provided at the jaw interface in order to allow the bearing adapter 50 to yaw and roll with the pedestal during lateral, vertical and steering movement.

The outer race 52 provides vertical load transfer from the pedestal 26 to the axle bearing 30. The inner race 58 has a formed spherical interface for connection with the axle bearing 30, thus allowing the pedestal 26 to pivotably attach to the wheel-set 21. As shown in FIG. 6B, an exploded perspective of bearing adapter 50, a top spacer 51, a bottom spacer 53, a cage 55, a plurality of ball bearings 57, and assembly fasteners 59 form the ball bearing cage assembly 56 in FIG. 6B. An assembly fastener 59 is preferably a ¼ inch screw and nut, although any fastening device may be used. The cage 55 and the ball bearings 57 are placed between the top 51 and bottom 53 spacers, and the assembly fasteners 59 connect the top 51 spacer to the bottom 53 spacers. Once the bearing adapter 50 is placed under load, the cage 55 and ball bearings 57 are sealed from contamination. The ball bearing cage assembly 56 is centered on the plurality of ball bearings 57 and retains them in their respective location. The ball bearing cage assembly 56 is situated between the outer race 52 and inner race 58, and preferably four assembly resilient members 43, 44, 45, 47 attach the outer race 52 to the inner race 58. The use of the assembly resilient members 43, 44, 45, 47 are preferably necessary only for assembly of the bearing adapter 50 and to allow for rotational freedom in operation.

This preferred assembly of the bearing adapter 50 allows yaw and roll freedom of the wheel-sets 21, 25 and pedestals 26, 27, 28, 29 while holding the bearing adapter 50 together. The spherical bearing adapter 50 can be machined to fit any standard axle bearing. The apparatus 10 thus absorbs lateral and longitudinal loads while allowing for yaw and roll freedom of the wheel-sets 21 and 25. Additionally, the bearing adapter 50 provides a normal force on the axle bearing 30 for all load conditions and eliminates moment on the axle bearing 30 thereby leading to longer life of the axle bearing 30.

The inner race 58 and outer race 52 are preferably made of a high strength ferrous casting, although a high strength material of similar strength may be used. The cage 55 is preferably made of steel. The top spacer 51 and bottom spacer 53 are preferably made of ultra-high molecular weight, high temperature polyethylene. The use of plastic for the construction of the top spacer 51 and bottom spacer 53 permits the weight of the car body 12 to elastically compress the plastic to form a seal around the plurality of ball bearings 57 thereby sealing the ball bearings 57 from the outside environment. In the preferred embodiment, there are twenty-two (22) one and one-half (1½) diameter inch steel ball bearings 57, although any quantity of ball bearings of the diameter sufficient to carry the vertical load may be used.

In addition to each pedestal 26, 27, 28, 29 being engaged to an end of a transversely extending axle 14 and 16, each pedestal 26, 27, 28, 29 is also movably attached to another pedestal 26, 27, 28, 29, as shown in FIG. 1. Each pedestal 26, 27, 28, 29 is movably attached to another pedestal 26, 27, 28, 29 located in the same plane parallel to the longitudinal axis 18, as shown in FIG. 4A. As shown in FIG. 2, each pedestal 26, 27, 28, 29 is preferably movably attached to another pedestal 26, 27, 28, 29 by an equalizing side frame suspension 60*a*, 60*b* and steering component 90.

Figure 7:
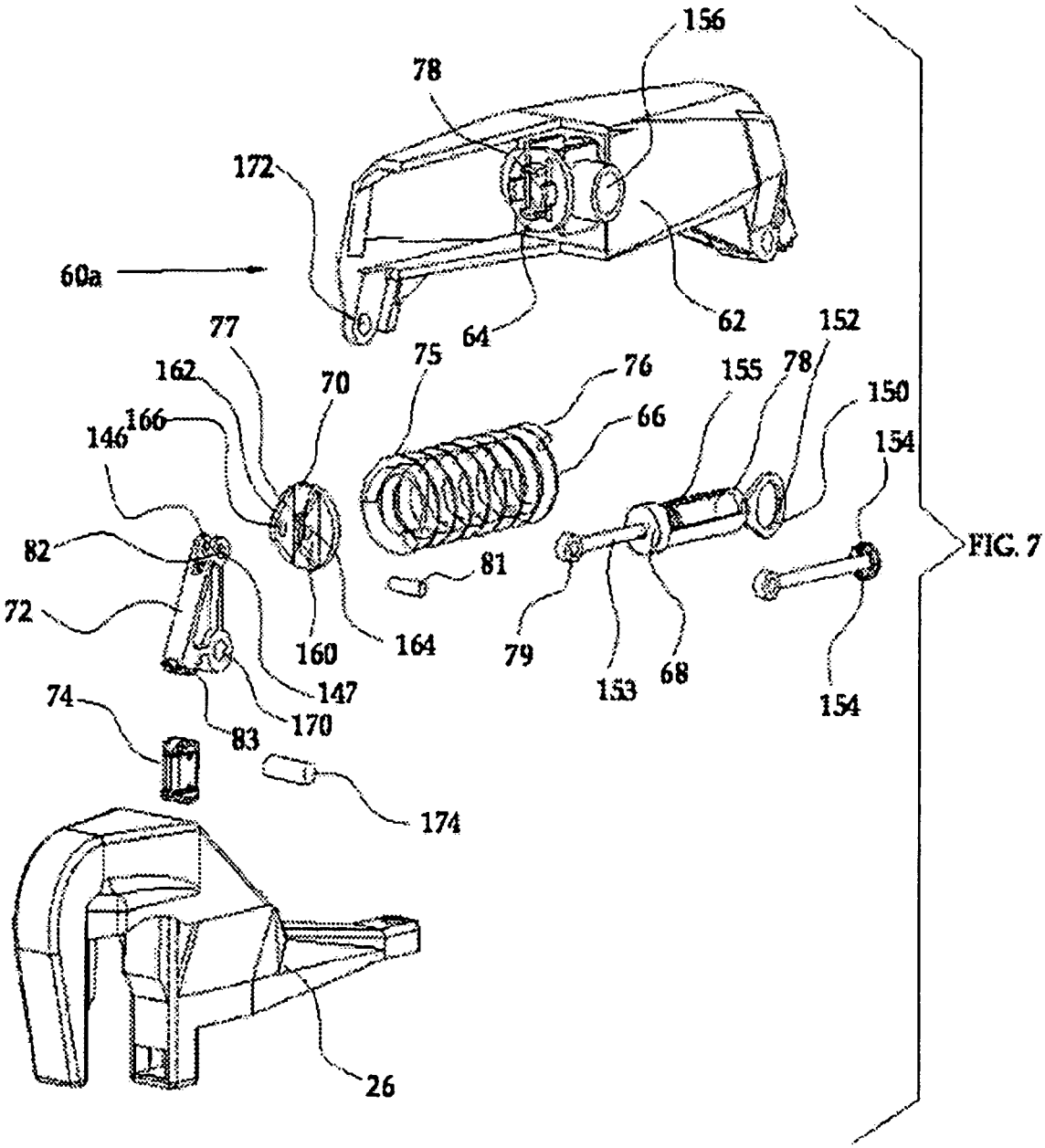
FIG. 7 is an illustration of an equalizing side frame suspension 60*a* and an exploded perspective view of one half of the components contained within housing 62.

In the preferred embodiment, and as detailed in FIG. 7, an equalizing side frame suspension 60*a* has a housing 62. A housing 62 is placed within a groove 61 created between a first plate 65 and second plate 67, and a groove 61 is located proximate each end 22, 24 of the bolster 20, as shown in FIG. 5A. The first plate 65 and second plate 67 each have an orifice 71 and 73 respectively. As shown in FIG. 7, the housing 62 has an orifice 156 and the orifice 156 is aligned with orifice 71 and orifice 73 such that a passage is formed. This arrangement allows for a pin 63*a, b*, as shown in FIG. 5A, to be placed within this passage to connect the housing 62, and therefore the equalizing side frame suspension 60*a*, to the bolster 20, as shown in FIG. 1. In FIG. 7, one half of a housing 62 is cut-away and the elements contained therein are exploded for better illustration. For ease of discussion, only one half of the elements that make up the equalizing side frame suspension 60*a* and associated housing 62 are discussed. One skilled in the art would understand that a substantially identical arrangement of elements are present within the other half of the equalizing side frame suspension 60*a* and associated housing 62.

As illustrated in FIG. 7, one half of a housing 62 preferably contains a rear suspension lug 64, a resilient member 66, a viscous damper 68, and a spring and damper lug 70. One half of an equalizing side frame suspension 60*a* also has a non-linear force equalizer 72, and a rolling universal joint 74. The rear suspension retainer lug 64 is preferably cast as part of the housing 62 and contains an orifice 78, positioned generally perpendicular to the passage created by orifices 156, 71 and 73, not shown in FIG. 7, and opens into a space within orifice 156. One end of a resilient member 76 is positioned to abut the lug 64, whereby the lug 64 holds the resilient member 66 in place. The viscous damper 68 is then preferably placed within the resilient member 66. The viscous damper 68 has a cyclical retainer 150 that is positioned through the lug orifice 78 and into the space within orifice 156. The cyclical retainer 150 has an orifice 152 that aligns with the passage created by orifices 156, 71, and 73. As stated above, a pin 63*a* or 63*b* as shown in FIG. 5A, can then be placed within the passage created by orifices 156, 71, 73 and 152 to connect the bolster 20 to the equalizing side frame suspension 60*a* and associated components, as shown in FIG. 1.

The viscous damper 68 is preferably a tunable hydraulic damper. The viscous damper 68, a portion of which is cut-away in FIG. 7, has a check valve 154, which preferably has a flow control office that can be adjusted dependant on ride requirements. The preferred check valve 154 is preferably a screw with a flow control orifice, which extends from the exterior, through the piston 155 of the viscous damper 68 into the internal cylinder of the viscous damper 68. Varying the size of the flow control orifice adjusts the ride requirements, which may be based on the weight of the car body and lading, speed requirements, track conditions and centers of gravity.

The plunger arm 153 of the viscous damper 68 has an orifice 79. The plunger arm 153 is positioned through an orifice 77 of the spring and damper lug 70. The lug 70 is positioned to retain a second end 75 of the resilient member 66. The lug 70 has first plate 160 and second plate 162, each having an orifice 164 and 166 respectively. The orifice 79 of the plunger arm 153 is aligned with orifices 164 and 166 forming a passage. A first end 82 of the non-linear force equalizer 72 has a pair of orifices 146 and 147 that are positioned to align with the passage formed by orifices 79, 164, and 166. A pin 81 is placed within the passage formed by orifices 79, 164, 166, 146 and 147, thereby movably connecting the viscous damper 68, non-linear force equalizer 72 and spring and damper lug 70, as well as associated components.

Figure 8:
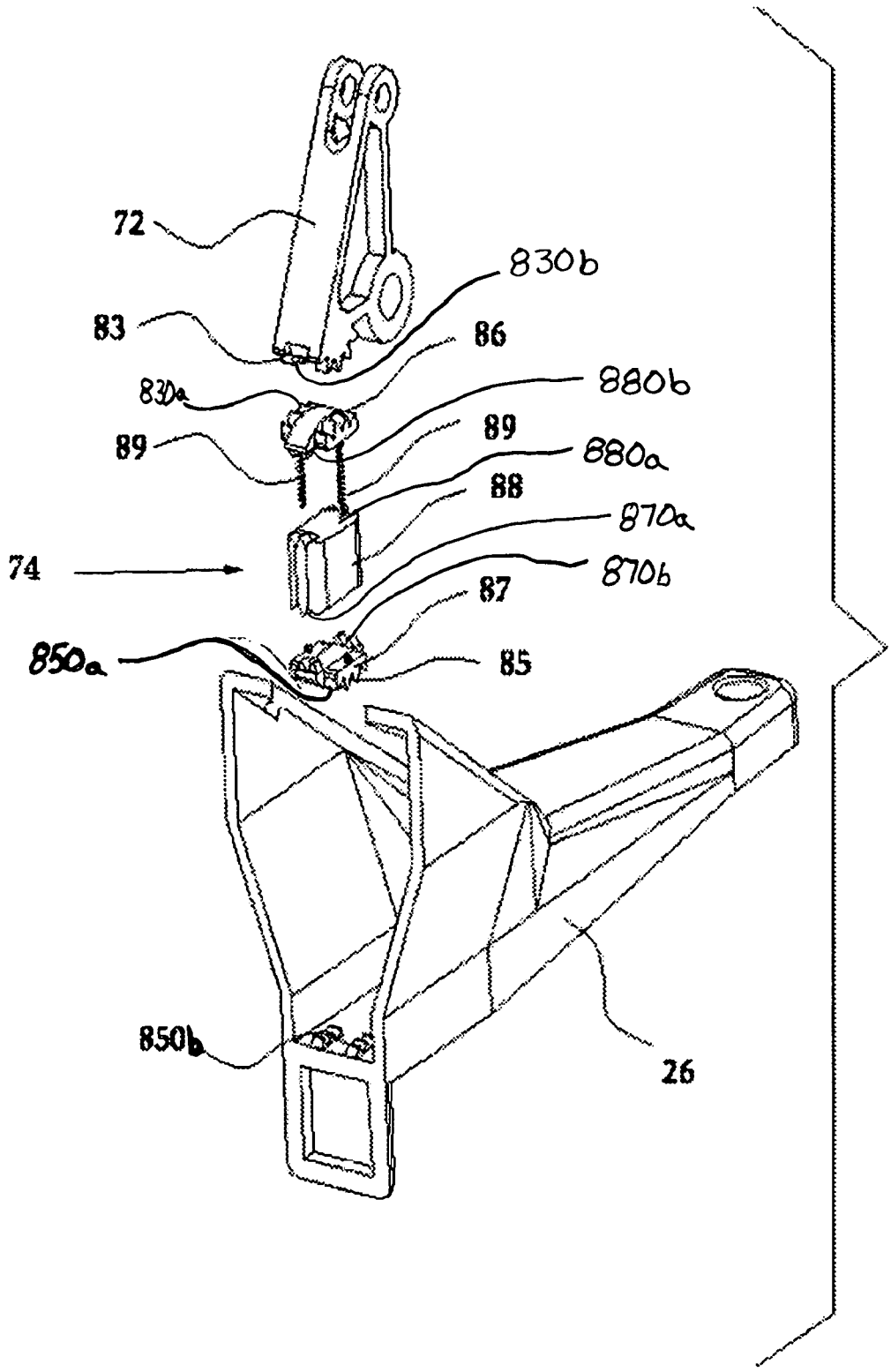
FIG. 8 is an exploded perspective view of aspects of the rolling universal joint 74 of the apparatus 10.

As will be shown in more detail in FIG. 8, a second end 83 of the non-linear force equalizer 72 preferably has a rounded saw tooth face 830*a* for movably connecting to an opposing rounded saw-tooth face 830*b* of the rolling universal joint 74, thereby interlocking the non-linear force equalizer 72 and rolling universal joint 74 and allowing for rocking movement. The second end 85 of the rolling universal joint 74 preferably has a rounded saw-tooth face 850*a* that movably connects to opposing rounded saw-tooth faces 850*b* of the pedestal 26, thereby interlocking the rolling universal joint 74 to the pedestal 26 and allowing for a rocking movement.

As shown in FIG. 7, the non-linear force equalizer 72 has an orifice 170 that aligns with orifice 172 of the housing 62 forming a passage. A pin 174 is then placed within this passage to pivotably mount the non-linear force equalizer 72 to the housing 62. This configuration of the equalizing side frame suspension 60*a* provides for substantial equalization of load at each wheel 13*a*, 13*b* connected to pedestals 26, 27 and further provides for absorbance of vertical bounce energy experienced by the wheels 13*a*, 13*b*, 15*a*, 15*b* and pedestals 26, 27, 28, 29, as shown in FIG. 1.

In the preferred embodiment, and as shown in FIG. 8, the rolling universal joint 74 contains a top section 86, a bottom section 87, an inner section 88, and assembly resilient members 89. The inner section 88 has a gear-face 880*a* for connecting to an opposing gear face 880*b* of the top section 86, which allows for an interlocking connection. Additionally, the inner section 88 has a gear face 870*a* for connecting to an opposing gear face 870*b* of the bottom section 87, which allows for an interlocking connection. This interlocked connection allows lateral movement of the rolling universal joint 74. Assembly resilient members 89 are preferably springs that connect the top section 86 to the bottom section 87. As shown in FIG. 8 the rounded interlocking connection of the top section 86 to the second end 83 of the non-linear force equalizer 72 and the rounded interlocking connection of the second end 85 of the rolling universal joint 74 to opposing rounded saw-tooth face 850*a* of the pedestal 26 provides for longitudinal movement of the rolling universal joint 74. In the preferred embodiment, the housing 62, rear suspension retainer lug 64, spring and damper retainer lug 70, non-linear force equalizer 72 and rolling universal joint 74 are preferably constructed of a high strength ferrous casting, although a high strength material of similar strength may be used.

Figure 4B:
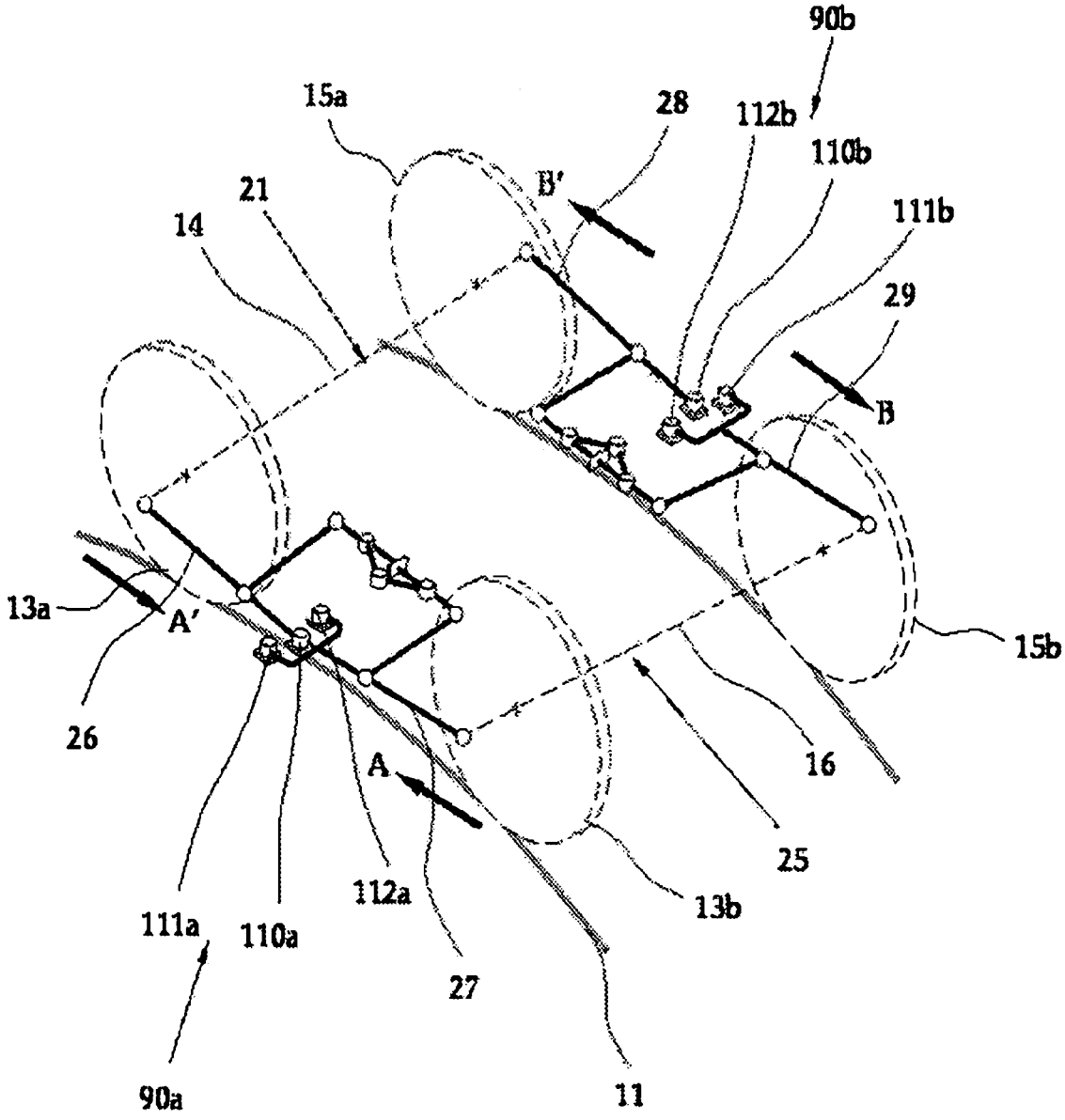
FIG. 4B is an illustration which shows a graphical representation of wheel set orientation and pivot points relative to the track and frame for curved track operation.
Figure 4C:
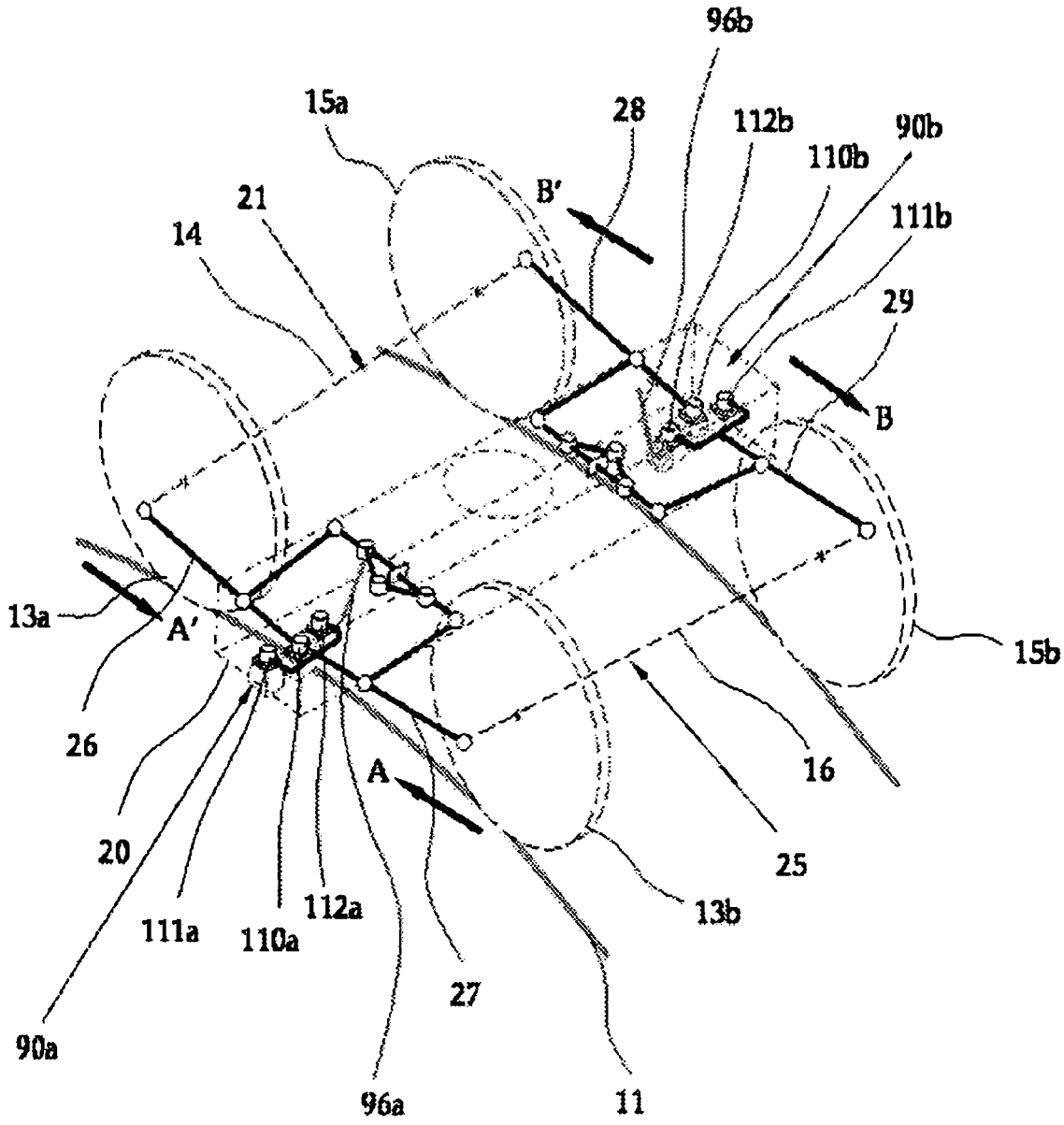
FIG. 4C illustrates the movement of the steering components during curved track operation.
Figure 9:
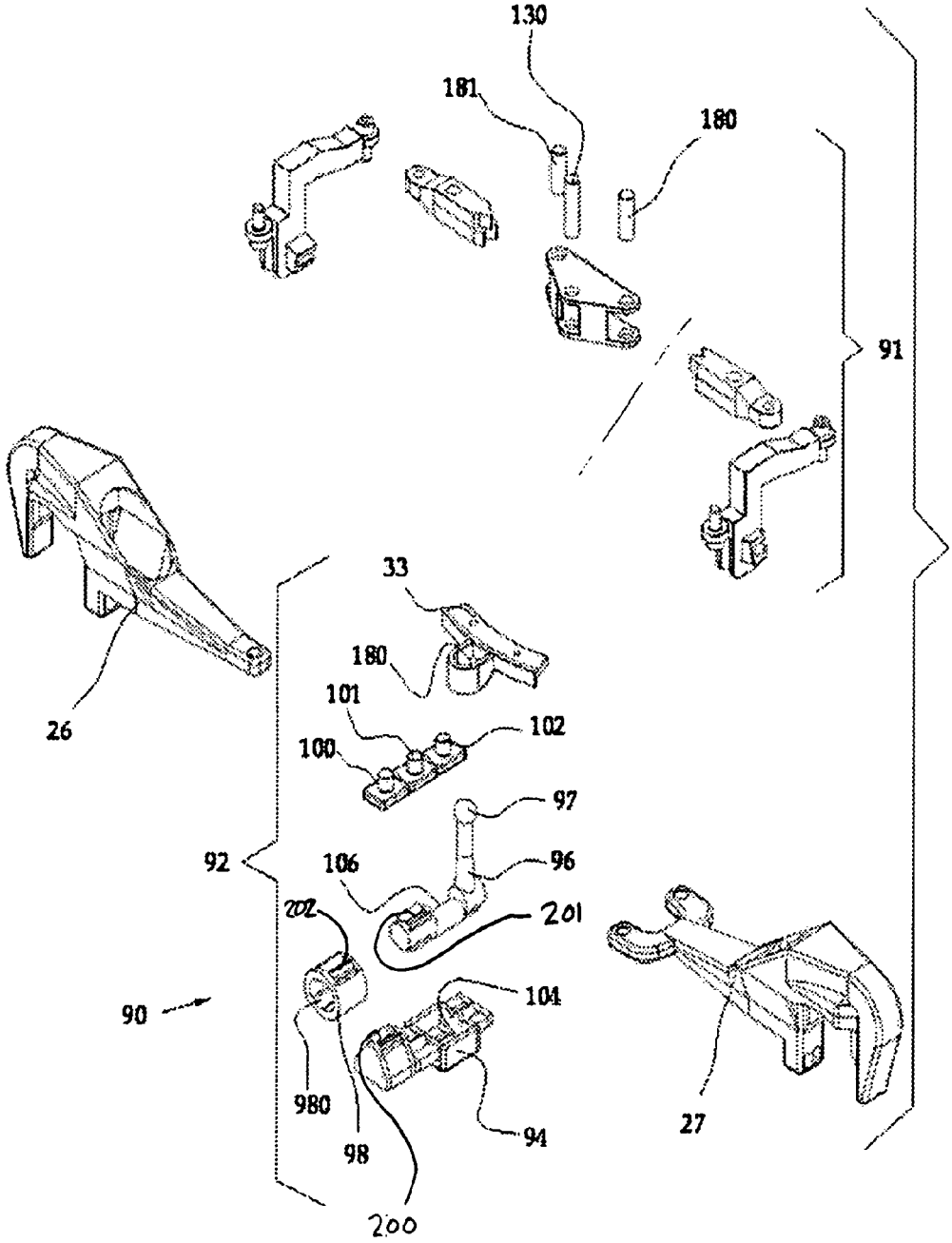
FIG. 9 is an exploded perspective view of aspects of the steering component 90 including the reactive lateral steering component 91 and the rack and pinion steering components 92 of the apparatus 10.

As shown in FIG. 4C, the preferred means for performing car body steering is accomplished through use of a pair of steering components 90*a*, 90*b*. FIG. 9 details more greatly a steering component 90. For discussion purposes, only one steering component 90 will be discussed. A steering component 90 preferably has a reactive lateral suspension steering component 91 and rack and pinion steering component 92 as shown in FIG. 2. As shown in FIG. 9, the rack and pinion steering component 92 is comprised of a gear tray 94, which is preferably formed as part of bolster 20, a pinion 96, an idler 98, and a plurality of racks 100, 101, 102. The idler 98 slides over a pinion recess 106 of the pinion 96. The combined idler 98 and pinion 96 rest on the gear tray 94, where the idler 98 rests within recess 104. This configuration allows the idler 98 to rotate freely about recess 106. The aperture 980 of idler 98 provides freedom of movement about recess 106 of pinion 96.

As shown in FIGS. 2 and 9, rack 100 engages and rests on the gear tray 94, rack 101 engages and rest on the pinion 96, and rack 102 engages and rests on the idler 98. The racks 100, 101, and 102 engage respectively gear teeth 200, 201, 202 of gear tray 94, pinion 96, and idler 98, and running tooth clearance is established by providing a rolling surface between the gear teeth 200, 201, 202. In the preferred embodiment, the gear tray 94, pinion 96, idler 98, and racks 100, 101, and 102 are preferably constructed of a high strength ferrous casting, although a high strength material of similar strength may be used.

As shown in FIGS. 4C and 9, a steering component 90 rotatably attaches to a pair of pedestals 26, 27 permitting pivotal movement about the first pedestal attachment point 110*a*, 110*b* when the first pedestal 26 rotatably attaches to the rack 101 on the pinion 96, and permitting pivotal movement about the second pedestal attachment point 111*a*, 111*b* and third pedestal attachment point 112*a*, 112*b* when a second pedestal 27 rotatably attaches to the rack 100 on the gear tray 94 and to the rack 102 on the idler 98. The steering component 90 rotationally attaches to the apparatus 10 when a ball bearing 97 of the pinion 96 attaches through an opening in the bolster 20 to a receptive orifice 180 within plate 33 of the side bearing 32.

As shown in FIG. 4B, as a rail 11 turns out from under the car body 12, not shown, wheel-sets 25 and 21 naturally yaw due to the cone shape of wheels 13*b*, 15*b* and 13*a*, 15*a*. Simultaneously, each steering component system 90*a*, 90*b* moves in the direction of the turn, thereby accurately steering each axle 14, 16. As shown in FIG. 4C, pinion 96*a* is allowed to rotate as well as translate across the bolster 20. The rotation of pinion 96*a* through rack 110*a* pulls pedestal 26 and wheel 13*a* to controlled alignment to the curve. The rotation of pinion 96*a* also translates pinion 96*a* across the bolster 20. The translation pulls and yaws bolster 20. Bolster 20 attachment through rack tray 94 and rack 100*a* pull pedestal 27 and wheel 13*b* to controlled alignment to the curve. The pinion 96*b* also creates rotate and translations in a direction opposite of pinion 96*a*. Thus, the rotation of pinion 96*b* pushes rack 110*b*, pedestal 28 and wheel 15*a* to controlled alignment to the curve. The rotation of pinion 96*b* also translates pinion 96*b* across the bolster 20. The translation pushes and yaws bolster 20. Bolster 20 attachment through rack tray 94 and rack 100*b* pushes pedestal 29 and wheel 15*b* to controlled alignment to the curve. Thus, entering the turn, pedestals 26, 27 and attached wheels 13*a*, 13*b* have the effect of being pulled together on the one side, represented by arrows A and A', and pedestals 28, 29 and attached wheels 15*a*, 15*b* have the effect of being pushed apart, represented by arrows B and B'. However, as will be shown, although each steering component system 90*a*, 90*b* is rigid and thereby retards the amount of movement of pedestals 26, 27, 28, 29, each steering component 90*a*, 90*b* simultaneously allows apparatus 10 to achieve pure rolling while decreasing the amount of friction generated.

Figure 11:
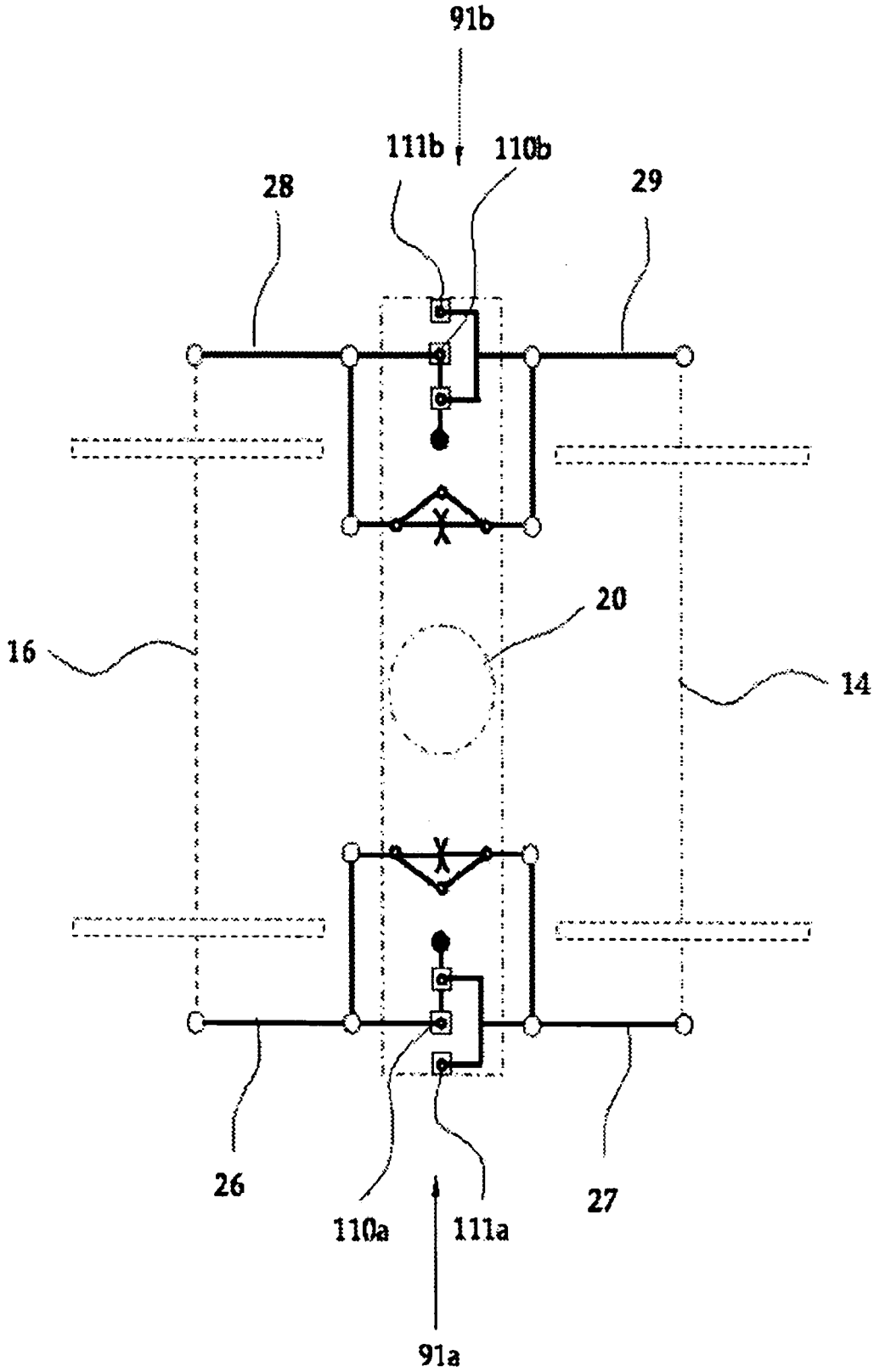
FIG. 11 is a representation of the geometry of pivot points of the steering component 90 used to accurately steer the apparatus 10.

As will be shown, the center of the car mass is located along pinions 96*a* and 96*b*. The wheelsets 21 and 25 are higher above track 11 than the pinions 96*a* and 96*b*. Since the pedestals 26, 27, 28, 29 are connected at these points and are allowed to swing, the pedestals act as a pendulum using the force of the mass of the car 12 acting on apparatus 10 to restore and center apparatus 10 above the track 11. Thus, a reactive lateral suspension steering component 91*a*, 91*b* of each steering component 90*a*, 90*b* uses this pendulum effect as a restoring force to always return the apparatus 10 back substantially to centering alignment. As shown in FIG. 11, the geometry of points from axle 14 to points 111*a*, 111*b* on the bolster 20 forms a trapezoid and the geometry of points from axle 16 to points 110*a*, 110*b* on the bolster 20 forms a parallelogram. The reactive lateral suspension steering component 91*a*, 91*b* pivotably connects pedestals 26, 27, 28, 29 thereby allowing a lateral force at one axle 14 to be reacted by the other axle 16. Thus, once the trapezoid side yaws, axle 14 of apparatus 10 steers to the center of the track regardless of which end of the apparatus 10 is leading.

Figure 10:
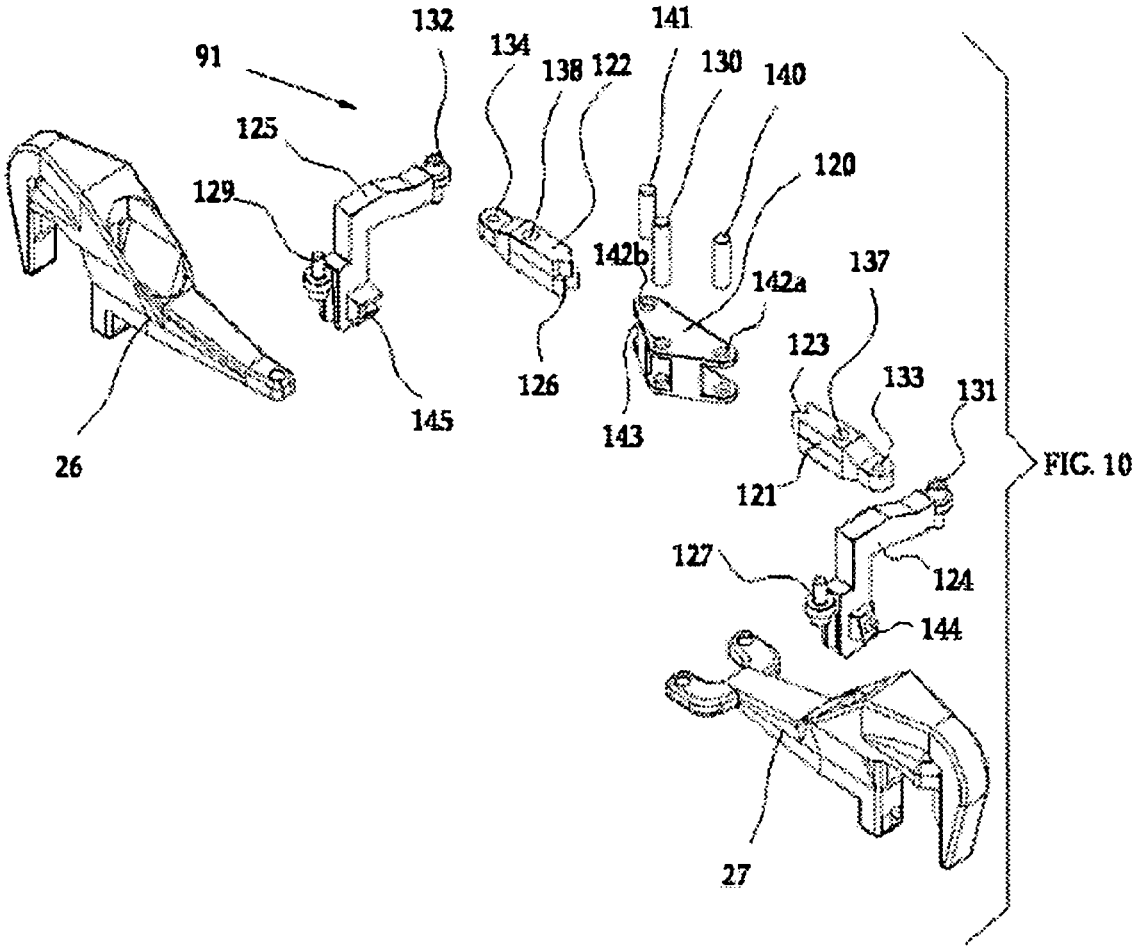
FIG. 10 is an exploded perspective view of aspects of the reactive lateral steering component 91.

FIG. 10 is an exploded perspective of a reactive lateral suspension steering component 91 and details more greatly the component 91. The reactive lateral suspension steering 91 has a selector housing 120. A pin 130 is preferably used to secure the selector housing 120 to the bolster 20. Preferably, pin 130 is placed within orifice 143 of the housing and an orifice in the bolster 20, not shown. As shown in FIG. 10, the selector housing 120 has a pair of selectors 121, 122 attached, which contain opposing gear faces 123, 126 that allow the selectors 121, 122 to pivot within the selector housing 120. The selectors are attached by pins 140, 141 being placed through selector orifices 137, 138 and housing orifices 142*a*, 142*b*. The reactive lateral suspension 91 further has a plurality of struts 124, 125, where each strut 124, 125 is movably attached to a selector 121, 122 by ball joints 131, 132 placed through selector orifices 133, 134. A strut 124, 125 of the reactive lateral suspension 91 has a ball joint 127, 129 which movably attaches each strut 124, 125, preferably by ball joints and cap screws to a wheel-set bearing 128 of the pedestals 26, 27, as shown in FIGS. 3. In this preferred arrangement, the wheel-set bearing 128 is located above the pinion 96. As discussed above, pinion 96 represents the center of the car body mass and acts as a pendulum between the attached pedestals 26, 27, 28, 29. The selectors 121, 122 bottom against the back of the selector housing 120 to interlock the wheel-set 21, 25 to limit lateral movement and provide rigidity to the apparatus 10.

As is shown, each reactive lateral suspension steering component 91*a*, 91*b* of the apparatus uses the pedestals 26, 27, 28, 29 for swing hangers, allowing the bolster 20 to work as a pendulum, thereby centering the car mass between the wheel-sets 21, 25. The car body steering utilizes the pedestals 26, 27, 28, 29 to detect and correct overbalance, unbalanced curves such as single rail vertical curvature and lateral wheel-set acceleration associated with hunting. The connection between the wheel-sets 21, 25 and bolster 20 also turns the wheel-sets 21, 25 away from any unbalanced curve. In the preferred embodiment, selector housing 120, selectors 121, 122, and struts 124, 125 are preferably constructed of a high strength ferrous casting, although a high strength material of similar strength may be used.

Figure 12:
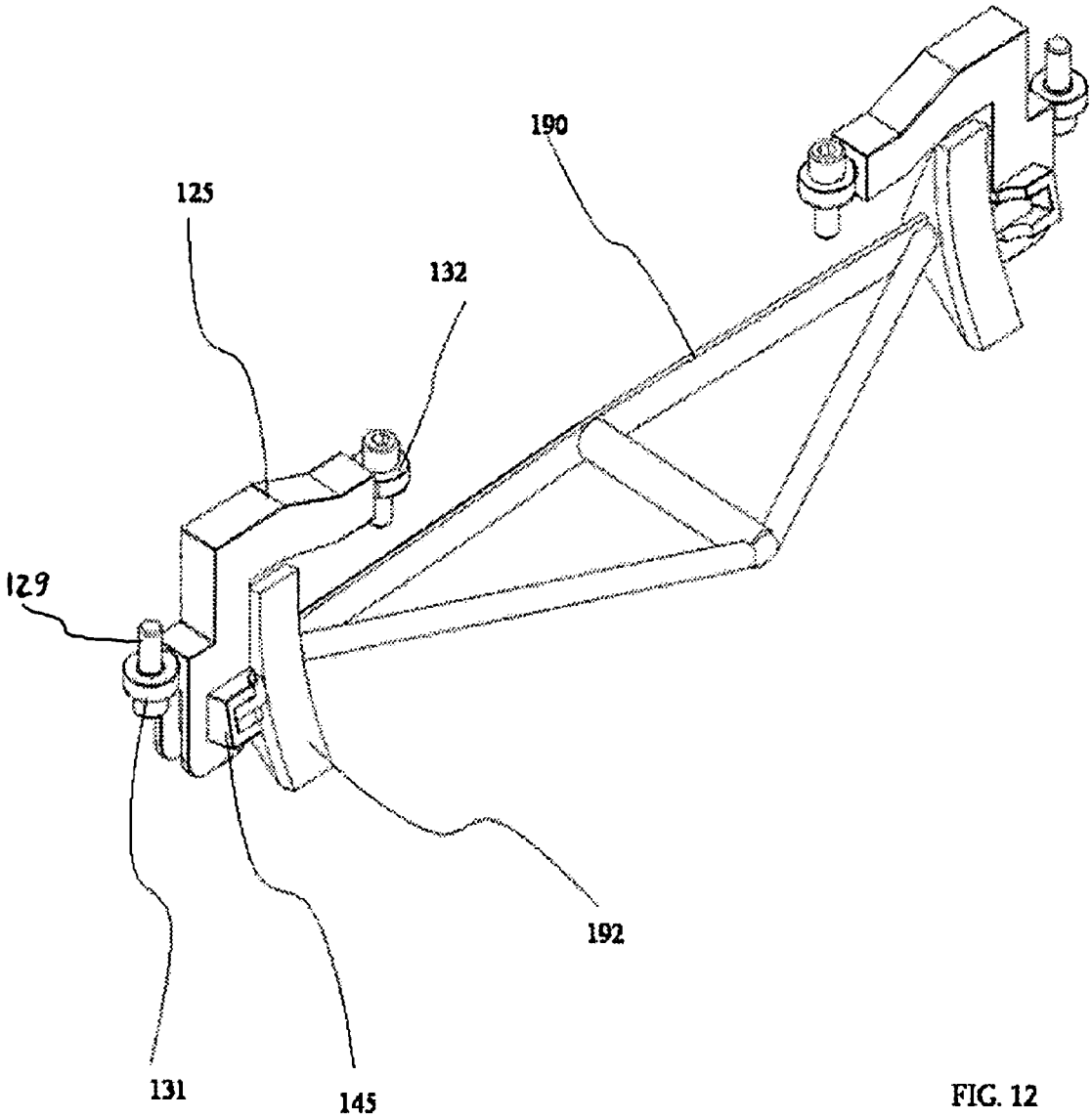
FIG. 12 is a depiction of the positioning of the brake beam 190.

The struts 124, 125 also have brake guide brackets 144, 145 that provide for positioning of a brake beam 190. A brake guide bracket 145 is the preferred means for maintaining full brake shoe contact on a wheel when brakes are applied. As shown in FIG. 12, the brake beam 190 slides into the guide bracket 145. The positioning allows for an attached brake shoe 192 to rotate about the ball joints 129 and 132, as shown in FIG. 12, during steering. Thus, when the brakes are applied, brake shoe 192 slides up the guide bracket 145 and is allowed to rotate about ball joints 129 and 132 for full brake shoe 192 contact on the wheel (not shown). This action allows the brake envelope to maintain a constant position relative to a wheel thereby saving brake shoe life.

The apparatus as described herein has demonstrated reduced energy consumption. Resistance tests were conducted using a loaded 100 ton open hopper car. The tests were conducted using the Train Resistance test methods established for the AAR's "Energy Program." The loaded car body steering truck rolling resistance was 1.0 pound per ton (lbs/ton) of car weight on straight track and added only 0.1 pound per ton of car weight per degree of curvature for curved track. The track foundation flexibility creates resistance to rolling. The track deflection and sub-grade soil dampening have a rolling resistance of 0.8 to 1.0 lbs/ton. By subtracting the track foundation resistance from the truck rolling resistance, it is determined that the car body steering truck was within 0.2 to 0.00 lbs/ton of achieving pure rolling.

The means for performing car body steering aligns the wheel-sets for straight and all degrees of track curvature. The steering geometry establishes an average angle of attack between the wheel and rail of less that one mil-radian (0.057 degrees) on straight or curved track. Lead axle displacement was measured to determine the angle of attack as it progressed through a 12 degree curve. The lead axle displacement is zero angle of attack on tangent track. The lead axle displacement follows the spiral curve entry to ideal displacement or zero angle of attack for the constant radius portion of the curve. The lead axle displacement follows the spiral curve exit out of the curve to zero angle of attack back to tangent track. The steering mechanism governs the axle displacement and steering force. The measured steering force showed minimal force required to follow the track with no wheel slippage which indicates no tread wear.

As described above, in the preferred embodiment, many components of apparatus 10 are constructed of high strength ferrous casting using the lost foam process, although a high strength material of similar strength may be used. The use of the lost foam process to construct the component parts permits the parts to provide an ideal load path as well as minimizing overall weight.

The use of this material and process makes the apparatus 10 light weight, yet high strength. By creating the apparatus 10 out of high strength ferrous casting, the weight of the apparatus 10 has been reduced approximately 1,000 lbs. per truck as compared to conventional three piece trucks.

While the invention has been described in connection with a preferred embodiment, it will be understood that it is not intended that the invention be limited to that embodiment. On the contrary, it is intended to cover all alternatives, modifications and equivalents as may be included within the spirit and scope of the invention as disclosed.

As to the manner of usage and operation of the present invention, same should be apparent from the above disclosure, and accordingly no further discussion relevant to the manner of usage and operation of the present invention shall be provided.

With respect to the above description then, it is to be realized that the optimum dimensional relationships for the parts of the present invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered illustrative of only the principles of the present invention. Further, since numerous modifications and changes will readily occur to those skilled in the art, it is not desired to limit the claims to the exact construction and operation shown and described, and accordingly, all suitable modifications and equivalents may be resorted to, falling within the scope of the claims.

What claimed is:

1. A linear steering truck apparatus, for mounting upon a railroad car body, the linear steering truck apparatus having at least two transversely extending axles, and each axle being pivotably mountable to the railroad car body, the linear steering truck apparatus having a longitudinally extending axis in the direction of travel of the truck when the truck is traveling in a straight line, the linear steering truck apparatus further having a transverse axis extending generally perpendicular to the longitudinal axis, the transverse axis being positioned at a midpoint along the longitudinal axis, the linear steering truck apparatus comprising:

a. a bolster member having two ends, the bolster being located along the transverse axis extending generally perpendicular to the longitudinal axis, generally located between and parallel to the transversely extending axles;

b. a means for attaching the linear steering truck to the car body;

c. a plurality of pedestals and a corresponding plurality of bearing adapters, each bearing adapter having an outer race, a resilient member, a ball bearing cage assembly, and an inner race, said outer race having a spherical and first interlocking interface, the first interlocking interface movably attaching to a second interlocking interface of one end of a pedestal, said ball bearing cage assembly having a top spacer, a bottom spacer, a cage, a plurality of ball bearings, and an assembly fastener, the assembly fastener connecting the top and bottom spacers thereby sealing the cage and the plurality of bearings within the top and bottom spacers, said ball bearing cage assembly being located between the outer race and inner race, said resilient member attaching the outer race to the inner race, said inner race having an interface with the axle bearing, the interface allowing the pedestal to pivotably attach to the axle bearing while allowing for yaw and roll freedom thereby providing a normal force on the axle bearing for lateral and longitudinal loads and eliminates moment on the axle bearing, each bearing adapter movably attaching a corresponding pedestal to an axle bearing, the axle bearing being rotationally engaged to one end of a transversely extending axle, and at least one pedestal being movably attached to at least one other pedestal situated in the same plane along the longitudinal axis; and d. a means for performing car body steering, wherein the geometry of pivot points from one axle to the bolster form a trapezoid and the geometry of pivot points from another axle to the bolster form a parallelogram, the pedestals being pivotably connected so that a lateral force at one axle is reacted by the other axle, wherein the car body mass acts as a pendulum mass restoring force, and the apparatus being steered to the center of the track with either end of the truck leading after the trapezoid side yaws.

2. The apparatus of claim 1 wherein the outer race and inner race are constructed of high strength ferrous.

3. The apparatus of claim 2 wherein the outer race and inner race are constructed of high strength ferrous casting using the lost foam process.

4. The apparatus of claim 1 wherein the top spacer and bottom spacer are constructed of ultra-high molecular weight, high temperature polyethylene.

5. The apparatus of claim 1 wherein the plurality of ball bearings comprise a plurality of 1½ in. diameter ball bearings.

6. A linear steering truck apparatus, for mounting upon a railroad car body, the linear steering truck apparatus having at least two transversely extending axles, and each axle being pivotably mountable to the railroad car body, the linear steering truck apparatus having a longitudinally extending axis in the direction of travel of the truck when the truck is traveling in a straight line, the linear steering truck apparatus further having a transverse axis extending generally perpendicular to the longitudinal axis, the transverse axis being positioned at a midpoint along the longitudinal axis, the linear steering truck apparatus comprising:

a. a bolster member having two ends, the bolster being located along the transverse axis extending generally perpendicular to the longitudinal axis, generally located between and parallel to the transversely extending axles;

b. a means for attaching the linear steering truck to the car body;

c. a plurality of pedestals and a plurality of equalizing side frame suspensions, a pedestal engaged to an axle bearing, the axle bearing being rotationally engaged to one end of a transversely extending axle, at least one equalizing side frame suspension movably attaching at least one pedestal to at least one other pedestal situated in the same plane along the longitudinal axis; wherein each equalizing side frame suspension has a housing, the housing having a rear suspension retainer, a resilient member, a viscous damper, a spring and damper retainer, the equalizing side frame suspension further having a non-linear force equalizer and a rolling universal joint, wherein a rear suspension retainer fixedly attaches within the housing, a first end of a resilient member being positioned adjacent the rear suspension retainer and a second end of the resilient member being positioned adjacent a spring and damper retainer, the resilient member having a passage, the viscous damper being located within the passage, a first end of the viscous damper movably attaching to the rear suspension retainer and a second end of the viscous damper movably attaching to a spring and damper retainer, a first end of the non-linear force equalizer being movably attached to the spring and damper retainer and a second end of the non-linear force equalizer being movably attached to a first end of the rolling universal joint, the second end of the rolling universal joint being movably attached to a pedestal, wherein the equalizing side frame suspension provides for equalization of load at each wheel connected to a pedestal and further provides for absorbance of vertical bounce energy experienced by the wheels and pedestals; and d. a means for performing car body steering, wherein the geometry of pivot points from one axle to the bolster form a trapezoid and the geometry of pivot points from another axle to the bolster form a parallelogram, the pedestals being pivotably connected so that a lateral force at one axle is reacted by the other axle, wherein the car body mass acts as a pendulum mass restoring force, and the apparatus being steered to the center of the track with either end of the truck leading after the trapezoid side yaws.

7. The apparatus of claim 6 wherein the rolling universal joint being movably connected to a pedestal, the rolling universal joint having a top section, a bottom section, an inner section, and a plurality of assembly resilient members, the inner section being movably attached between the top section and bottom section, the top section being connected to the bottom section by assembly resilient members, whereby the inside section allows lateral movement of the rolling universal joint and the top section and bottom section provide for longitudinal movement of the rolling universal joint, wherein the weight of the equalizing side frame suspension aligns the rolling universal joint to the pedestal, thereby preventing bending force and uneven wear on the joint.

8. The apparatus of claim 7 wherein the resilient member is contained substantially within the equalizing side frame suspension.

9. The apparatus of claim 7 wherein the resilient member is positioned substantially horizontally.

10. The device of claim 6 wherein the housing, rear suspension retainer, and spring and damper retainer are constructed of high strength ferrous casting.

11. The apparatus of claim 10 wherein the housing, rear suspension retainer, and spring and damper retainer of high strength ferrous casting are constructed using the lost foam process.

12. The apparatus of claim 6 wherein the resilient member is contained substantially within the equalizing side frame suspension.

13. The apparatus of claim 12 wherein the side bearings are positioned to direct the entire load of the car body equally through the bolster.

14. The apparatus of claim 6 wherein the resilient member is positioned substantially horizontally.

15. The apparatus of claim 14 wherein the side bearings are positioned to direct the entire load of the car body equally through the bolster.

16. A linear steering truck apparatus, for mounting upon a railroad car body, the linear steering truck apparatus having at least two transversely extending axles, and each axle being pivotably mountable to the railroad car body, the linear steering truck apparatus having a longitudinally extending axis in the direction of travel of the truck when the truck is traveling in a straight line, the linear steering truck apparatus further having a transverse axis extending generally perpendicular to the longitudinal axis, the transverse axis being positioned at a midpoint along the longitudinal axis, the linear steering truck apparatus comprising:

a. a bolster member having two ends, the bolster being located along the transverse axis extending generally perpendicular to the longitudinal axis, generally located between and parallel to the transversely extending axles;

b. a means for attaching the linear steering truck to the car body;

c. a plurality of pedestals, a pedestal engaged to an axle bearing, the axle bearing being rotationally engaged to one end of a transversely extending axle, and at least one pedestal being movably attached to at least one other pedestal situated in the same plane along the longitudinal axis; and d. a pair of rack and pinion steering components, each steering component comprising a gear tray, a pinion, an idler, and a plurality of racks, the gear tray having a recess, the pinion rotationally engaging the gear tray recess and having a pinion recess, the idler engaging the pinion recess, one of said racks engaging the gear tray, one of said racks engaging the pinion, and one of said racks engaging the idler, a first pedestal rotationally attaching to the rack on the pinion, a second pedestal rotationally attaching to the rack on the gear tray and to the rack on the idler, each pinion being rotationally attached to a car body plate, whereby as a rail turns out from under the car body, yawing of a wheel-set due to cone shape of wheels, one wheel radius becomes smaller and one larger, thereby allowing the steering system to move in the direction of the turn to accurately steer each axle, rotation of one pinion pulls the pedestal and wheel in on one side and pushes the pedestal and wheel out on the other, the bolster moves in the opposite direction from the pinion by the pinion translating across the bolster, in response the pedestals and wheels attached to the bolster at the gear set tray are pulled in on one side, and the pedestals and wheels attached to the bolster at the gear set tray on the other side are pushed out, thereby allowing the idlers to roll freely supporting the other side of the pedestals, wherein the geometry of pivot points from one axle to the bolster form a trapezoid and the geometry of pivot points from another axle to the bolster form a parallelogram, the pedestals being pivotably connected so that a lateral force at one axle is reacted by the other axle, wherein the car body mass acts as a pendulum mass restoring force, and the apparatus being steered to the center of the track with either end of the truck leading after the trapezoid side yaws.

17. The device of claim 16 wherein the gear tray, pinion, idler and racks are constructed of high strength ferrous casting.

18. The apparatus of claim 17 wherein the gear tray, pinion, idler and racks constructed of high strength ferrous casting are constructed using the lost foam process.

19. A linear steering truck apparatus, for mounting upon a railroad car body, the linear steering truck apparatus having at least two transversely extending axles, and each axle being pivotably mountable to the railroad car body, the linear steering truck apparatus having a longitudinally extending axis in the direction of travel of the truck when the truck is traveling in a straight line, the linear steering truck apparatus further having a transverse axis extending generally perpendicular to the longitudinal axis, the transverse axis being positioned at a midpoint along the longitudinal axis, the linear steering truck apparatus comprising:

a. a bolster member having two ends, the bolster being located along the transverse axis extending generally perpendicular to the longitudinal axis, generally located between and parallel to the transversely extending axles;

b. a means for attaching the linear steering truck to the car body;

c. a plurality of pedestals, a pedestal engaged to an axle bearing, the axle bearing being rotationally engaged to one end of a transversely extending axle, and at least one pedestal being movably attached to at least one other pedestal situated in the same plane along the longitudinal axis;

d. a plurality of side bearings attaching the linear steering truck to the car body, the side bearings substantially supporting the vertical load of the car body; and e. means for performing car body steering comprising a plurality of steering components, each of said steering components comprising a reactive lateral suspension having a selector housing, said selector housing being fixedly secured inside the bolster, the selector housing having a pair of selectors each containing opposing gear faces thereby allowing pivoting of the selectors within the selector housing, the reactive lateral suspension further having a plurality of struts, each strut being movably attached to a selector, a strut of the reactive lateral suspension further being movably attached to a wheel-set bearing of the pedestal, wherein the wheel-set bearing being located above the center of the car body mass such that the reactive lateral suspension absorbs hard stop energy by steering the car back on the center of the track, wherein the geometry of pivot points from one axle to the bolster form a trapezoid and the geometry of pivot points from another axle to the bolster form a parallelogram, the pedestals being pivotably connected so that a lateral force at one axle is reacted by the other axle, wherein the car body mass acts as a pendulum mass restoring force, and the apparatus being steered to the center of the track with either end of the truck leading after the trapezoid side yaws.

20. The device of claim 19 wherein the housing, selectors, and struts are constructed of high strength ferrous casting.

21. The apparatus of claim 20 wherein the housing, selectors, and struts constructed of high strength ferrous casting are constructed using the lost foam process.

22. The apparatus of claim 19 wherein the resilient member is contained substantially within the equalizing side frame suspension.

23. The apparatus of claim 19 wherein the resilient member is positioned substantially horizontally.

24. A linear steering truck apparatus, for mounting upon a railroad car body, the linear steering truck apparatus having at least two transversely extending axles, and each axle being pivotably mountable to the railroad car body, the linear steering truck apparatus having a longitudinally extending axis in the direction of travel of the truck when the truck is traveling in a straight line, the linear steering truck apparatus further having a transverse axis extending generally perpendicular to the longitudinal axis, the transverse axis being positioned at a midpoint along the longitudinal axis, the linear steering truck apparatus comprising:

a. a bolster member having two ends, the bolster being located along the transverse axis extending generally perpendicular to the longitudinal axis, generally located between and parallel to the transversely extending axles;

b. a means for attaching the linear steering truck to the car body;

c. a plurality of pedestals, a pedestal engaged to an axle bearing, the axle bearing being rotationally engaged to one end of a transversely extending axle, and at least one pedestal being movably attached to at least one other pedestal situated in the same plane along the longitudinal axis; and d. a means for performing car body steering, wherein the geometry of pivot points from one axle to the bolster form a trapezoid and the geometry of pivot points from another axle to the bolster form a parallelogram, the pedestals being pivotably connected so that a lateral force at one axle is reacted by the other axle, wherein the car body mass acts as a pendulum mass restoring force, and the apparatus being steered to the center of the track with either end of the truck leading after the trapezoid side yaws; and e. means for maintaining full brake shoe contact on a wheel when brakes are applied comprises a strut affixed to the steering means, the strut having joints and a brake guide bracket, the brake guide bracket being capable of receiving a brake beam and a brake shoe, whereby pivoting of the strut about the joints causes the brake shoe to maintain full contact on a wheel upon actuation of the brakes.

25. The apparatus of claim 24 wherein the resilient member is contained substantially within the equalizing side frame suspension.

26. The apparatus of claim 24 wherein the resilient member is positioned substantially horizontally.

27. A linear steering truck apparatus, for mounting upon a railroad car body, the linear steering truck apparatus having at least two transversely extending axles, and each axle being pivotably mountable to the railroad car body, the linear steering truck apparatus having a longitudinally extending axis in the direction of travel of the truck when the truck is traveling in a straight line, the linear steering truck apparatus further having a transverse axis extending generally perpendicular to the longitudinal axis, the transverse axis being positioned at a midpoint along the longitudinal axis, the linear steering truck apparatus comprising:

a. a bolster member having two ends, the bolster being located along the transverse axis extending generally perpendicular to the longitudinal axis, generally located between and parallel to the transversely extending axles;

b. a means for attaching the linear steering truck to the car body;

c. a plurality of pedestals, a pedestal engaged to an axle bearing, the axle bearing being rotationally engaged to one end of a transversely extending axle, and at least one pedestal being movably attached to at least one other pedestal situated in the same plane along the longitudinal axis; and d. a pair of rack and pinion steering components, each steering component comprising a gear tray, a pinion, an idler, and a plurality of racks, the gear tray having a recess, the pinion rotationally engaging the gear tray recess and having a pinion recess, the idler engaging the pinion recess, one of said racks engaging the gear tray, one of said racks engaging the pinion, and one of said racks engaging the idler, a first pedestal rotationally attaching to the rack on the pinion, a second pedestal rotationally attaching to the rack on the gear tray and to the rack on the idler, each pinion being rotationally attached to a car body plate, wherein the pinions are disposed to create substantially opposite and equal rotate and translation with respect to each other.

* * * * *